US010517347B2

(12) United States Patent
Suddaby

(10) Patent No.: US 10,517,347 B2
(45) Date of Patent: Dec. 31, 2019

(54) HELMET WITH MULTIPLE PROTECTIVE ZONES

(71) Applicant: Loubert S. Suddaby, Orchard Park, NY (US)

(72) Inventor: Loubert S. Suddaby, Orchard Park, NY (US)

( * ) Notice: Subject to any disclaimer, the term of this patent is extended or adjusted under 35 U.S.C. 154(b) by 477 days.

(21) Appl. No.: 14/615,011

(22) Filed: Feb. 5, 2015

(65) Prior Publication Data

US 2015/0143617 A1 May 28, 2015

Related U.S. Application Data

(63) Continuation-in-part of application No. 13/841,076, filed on Mar. 15, 2013, which is a continuation-in-part of application No. 13/412,782, filed on Mar. 6, 2012.

(51) Int. Cl.
*A42B 3/12* (2006.01)
*A42B 3/06* (2006.01)

(52) U.S. Cl.
CPC ..... *A42B 3/124* (2013.01); *A42B 3/064* (2013.01)

(58) Field of Classification Search
CPC ..... A42B 3/121; A42B 3/064; A42B 3/124; A42B 3/322; A42B 3/326; A42B 3/06; A42B 3/065; F41H 1/04
See application file for complete search history.

(56) References Cited

U.S. PATENT DOCUMENTS 1,251,537 A * 1/1918 Kempny ..... A42B 3/0473 2/411
1,456,183 A * 5/1923 Knight ..... A42B 1/08 2/412
1,652,776 A * 12/1927 Galanis ..... A42B 3/06 2/412
2,194,903 A 3/1940 Holstein
2,197,174 A * 4/1940 Crosby ..... A42B 3/06 2/6.8
2,306,362 A * 12/1942 Wolff ..... A42B 3/065 2/5
2,629,095 A * 2/1953 Kleinman ..... A42B 3/06 2/414
2,861,272 A 11/1958 Stuart et al.
3,089,144 A 5/1963 Cherup
(Continued)

FOREIGN PATENT DOCUMENTS

CN 201094314 8/2008
DE 19544375 3/1997
(Continued)

*Primary Examiner* — Sally Haden
(74) *Attorney, Agent, or Firm* — Simpson & Simpson, PLLC

(57) ABSTRACT

The present invention is a protective helmet having multiple zones of protection suitable for use in construction work, athletic endeavors, and similar activities. The helmet includes a hard outer protective shell, an inner shell and an elastomeric zone with the outer shell suspended over the inner shell. A plurality of sinusoidal springs are positioned within the elastomeric zone. In one embodiment, force indicators may be displayed that indicate the amount of force impacting a helmet. The force indicators may indicate impact force form both direct and rotational directions.

21 Claims, 33 Drawing Sheets

(56) References Cited

U.S. PATENT DOCUMENTS 3,107,356 A 10/1963 Pestronk et al.
3,153,242 A * 10/1964 Zygmund ..... A42B 3/064 2/411
3,167,069 A 1/1965 Lobelle
3,600,714 A 8/1971 Cade et al.
3,616,463 A 11/1971 Theodore et al.
3,668,704 A 6/1972 Conrov et al.
3,872,511 A 3/1975 Nichols
3,875,275 A 4/1975 Lemelson
3,946,441 A 3/1976 Johnson
4,023,209 A 5/1977 Frieder, Jr. et al.
4,075,717 A 2/1978 Lemelson
4,124,904 A 11/1978 Matthes
4,211,220 A 7/1980 O'Neill
4,213,202 A * 7/1980 Larry ..... A41D 31/005 2/456
4,307,471 A 12/1981 Lovell
4,345,338 A 8/1982 Frieder, Jr. et al.
4,566,137 A 1/1986 Gooding
4,586,200 A 5/1986 Poon
4,903,346 A 2/1990 Reddemann et al.
5,003,973 A 4/1991 Ford et al.
5,101,517 A 4/1992 Douglas
5,181,279 A 1/1993 Ross
5,204,998 A 4/1993 Liu
5,263,202 A 11/1993 Siherell
5,319,808 A 6/1994 Bishop et al.
5,444,870 A * 8/1995 Pinsen ..... A42B 3/0473 2/411
5,496,066 A 3/1996 Hoffmann et al.
5,815,846 A 10/1998 Calonge
5,950,244 A 9/1999 Fournier et al.
5,956,777 A 9/1999 Ponovich
6,014,769 A 1/2000 Baudou et al.
6,138,283 A 10/2000 Kress
6,378,140 B1 * 4/2002 Abraham ..... A42B 3/064 2/411
6,401,260 B1 * 6/2002 Porth ..... A42B 1/004 2/171
6,604,246 B1 8/2003 Obreja
6,658,671 B1 12/2003 Von Holst et al.
6,817,039 B1 11/2004 Grilliot et al.
8,117,676 B1 2/2012 Cardoso
8,176,574 B2 5/2012 Bryant et al.
2002/0073994 A1 6/2002 Patel
2003/0217483 A1 11/2003 Abraham
2007/0190292 A1 8/2007 Ferrara
2008/0229488 A1 9/2008 Kim
2008/0256686 A1 10/2008 Ferrara
2010/0000009 A1 1/2010 Morgan
2010/0023135 A1 1/2010 Rubie et al.
2011/0072548 A1 3/2011 Hersick et al.
2012/0210490 A1 8/2012 Harty
2012/0233745 A1 9/2012 Veazie
2012/0297526 A1 11/2012 Leon
2013/0061371 A1 3/2013 Phipps et al.
2013/0167289 A1 7/2013 Rensink et al.
2013/0185837 A1 * 7/2013 Phipps ..... A42B 3/12 2/2.5
2013/0305435 A1 * 11/2013 Surabhi ..... A42B 3/067 2/414
2014/0173810 A1 6/2014 Suddaby
2014/0215694 A1 8/2014 Grice
2015/0143617 A1 5/2015 Suddaby
2015/0208751 A1 7/2015 Day
2016/0029730 A1 2/2016 Day
2016/0128414 A1 5/2016 Gotti
2016/0157545 A1 6/2016 Bowman

FOREIGN PATENT DOCUMENTS

EP 0048442 3/1982
EP 1142495 A1 10/2001
JP 2001295129 10/2001
WO 8605369 A1 9/1986
WO WO 2010-151631 12/2010
WO 2011090381 7/2011

* cited by examiner

HELMET WITH MULTIPLE PROTECTIVE ZONES

This application is filed under 35 U.S.C. § 120 as a continuation-in-part of U.S. patent application Ser. No. 13/841,076 filed Mar. 15, 2013, which application is a continuation-in-part of U.S. patent application Ser. No. 13/412,782 filed Mar. 6, 2012. The entire disclosures of these applications are hereby incorporated herein by reference.

FIELD OF THE INVENTION

The invention relates to protective headgear, more particularly to sports or work place protective headgear, and still more particularly, to protective headgear designed to prevent or reduce head injury caused by linear or rotational forces.

BACKGROUND OF THE INVENTION

The human brain is an exceedingly delicate structure protected by a series of envelopes to shield it from injury. The innermost layer, the pia mater, covers the surface of the brain. Next to the pia mater is the arachnoid layer, a spidery web-like membrane that acts like a waterproof membrane. Finally, the dura mater, a tough leather like layer, covers the arachnoid layer and adheres to the bones of the skull.

While this structure protects against penetrating trauma because of the bones of the skull, the softer inner layers absorb too little energy before the force is transmitted to the brain itself. Additionally, while the skull may dampen some of the linear force applied to the head, it does nothing to mitigate the effects of angular forces that impart rotational spin to the head. Many surgeons in the field believe the angular or rotational forces applied to the brain are more hazardous than direct linear forces due to the twisting or shear forces they apply to the white matter tracts and the brain stem itself. In addition, because the person's head and the colliding object (including another person's head) are moving independently and in different angles, angular forces, as well as linear forces, are almost always involved in head injuries.

Mild traumatic brain injury (MTBI), more commonly known as "concussion," is a type of brain injury that occurs frequently in many settings such as construction worksites, manufacturing sites, and athletic endeavors and is particularly problematic in contact sports. While at one time concussion was viewed as a trivial and reversible brain injury, it has become apparent that repetitive concussions, even without loss of consciousness, are serious deleterious events that contribute to debilitating disease processes such as dementia and neuro-degenerative diseases for example Parkinson's disease, chronic traumatic encephalopathy (CTE), and pugilistic dementias.

U.S. Pat. No. 5,815,846 by Calonge describes a helmet with fluid filled chambers that dissipate force by squeezing fluid into adjacent equalization pockets when external force is applied. In such a scenario, energy is dissipated only through viscous friction as fluid is restrictively transferred from one pocket to another. Energy dissipation in this scenario is inversely proportional to the size of the hole between the full pocket and the empty pocket. That is to say, the smaller the hole, the greater the energy drop. The problem with this design is that, as the size of the hole is decreased and the energy dissipation increases, the time to dissipate the energy also increases. Because fluid filled chambers react hydraulically, energy transfer is in essence instantaneous, hence, in the Calonge design, substantial energy is transferred to the brain before viscous fluid can be displaced negating a large portion of the protective function provided by the fluid filled chambers. Viscous friction is too slow an energy dissipating modification to adequately mitigate concussive force. If one were to displace water from a squeeze bottle one can get an idea as to the function of time and force required to displace any fluid when the size of the exit hole is varied. The smaller the transit hole, the greater the force required and the longer the time required for any given force to displace fluid.

U.S. Pat. No. 3,872,511 to Nichols discloses a helmet with hard inner and outer shells with an intermediate zone between the two shells. The zone contains a plurality of fluid-filled bladders that are held to the inner surface of the outer shell by means of a valve. When an impact occurs the outer shell is forced into the zone squeezing the bladders. The valve closes upon impact causing the air to be retained in the bladders to cushion the impact from the user's head. However, because the movement of the bladders is restricted at impact, the force of the impact, although reduced is still directed into the head. In addition, the '511 patent makes no provision for mitigation of rotational forces striking the helmet.

U.S. Pat. No. 6,658,671 to Holst discloses a helmet with an inner and outer shell with a sliding layer in between. The sliding layer allows for the displacement of the outer shell relative to the inner shell to help dissipate some of the angular force during a collision applied to the helmet. However, the force dissipation is confined to the outer shell of the helmet. In addition, the Holst helmet provides no mechanism to return the two shells to the resting position relative to each other. A similar shortcoming is seen in the helmet disclosed in U.S. Pat. No. 5,596,777 to Popovich and European patent publication EP 0048442 to Kalman, et al.

German Patent DE 19544375 to Zhan discloses a construction helmet that includes apertures in the hard outer shell that allows the expansion of what appears to be a foam inner liner through the apertures to dispel some of the force of a collision. However, because the inner liner appears to rest against the user's head, some force will be directed toward rather than away from the head. In addition, there is no mechanism to return the expanded foam liner back to the inside of the helmet.

U.S. Patent Application Publication No. 2012/0198604 to Weber, et al. discloses a safety helmet for protecting the human head against repetitive impacts as well as moderate and sever impacts to reduce the likelihood of brain injury caused by both translational and rotational forces. The helmet includes isolation dampers that act to separate an outer liner from an inner liner. Gaps are provided between the ends of the outer liner and the inner liner to provide space to enable the outer liner to move without contacting the inner liner upon impact. However, it appears that several layers of isolation dampers and outer liners are necessary and no effective protection is provided to protect the brain from direct translational blows.

Clearly to prevent traumatic brain injury, not only must penetrating objects be stopped, but any force, angular or linear, imparted to the exterior of the helmet must also be prevented from simply being transmitted to the enclosed skull and brain. That is to say that the helmet must not merely play a passive role in dampening such external forces, but must play an active role in dissipating or misdirecting both linear and angular momentum imparted by said threes such that they have little or no deleterious effect on the delicate brain.

To achieve these ends one must conceive of the helmet much as biologic evolution has of the skull and the brain. That is to say, to afford maximal protection from linear and angular forces, the skull and the brain must be capable of movement independent of each other, and to have mechanisms which dissipate imparted kinetic energy, regardless of the vector or vectors by which it is applied.

To attain these objectives in a helmet design, the inner component (shell) and the outer component (shell or shells) must be capable of appreciable degrees of movement independent of each other. Additionally, the momentum imparted to the outer shell should both be directed away from and/or around the underlying inner shell and brain and sufficiently dissipated so as to negate deleterious effects.

Another difficulty with protective helmets is the tight fit of the helmet against the user's head. To fit properly, the narrow opening of a conventional helmet must be pulled over the widest part of the user's head Often the fit is so snug that it can be painful to pull the helmet over the user's head and protruding ears. Consequently, a user may use a larger helmet, which while more comfortable and easier to put on, does not provide the level of protection obtainable with a correctly fitted helmet.

Clearly, there is a need in the art and science of protective head gear design to mitigate these deleterious consequences of repetitive traumatic brain injury. There is also a need in the field for a helmet that can provide the protection achieved with a proper fit and still be relatively easy to pull over a user's head.

SUMMARY OF THE INVENTION

The present invention broadly comprises a protective helmet that includes a hard outer shell the hard outer shell including a plurality of apertures; a hard inner shell; a padded inner liner functionally attached to the hard inner shell; a plurality of fluid-filled bladders positioned between the outer shell and the padded inner liner; and, a plurality of elastomeric cords connecting the outer shell and the inner liner.

In an alternate embodiment, the present invention includes a hard outer shell the hard outer shell including a plurality of apertures; a hard inner shell; a padded inner liner functionally attached to the hard inner shell; an intermediate shell contacting the padded inner liner and enclosing a quantity of cushioning pieces; a plurality of fluid-filled bladders positioned between the outer shell and the padded inner liner; and, a plurality of elastomeric cords connecting the outer shell and the inner liner and passing through the intermediate shell. One or more of the elastomeric cords may have a thin portion and a thick portion, while one or more cords may have uniform thickness.

In a second alternate embodiment, the present invention includes protective helmet having multiple protective zones comprising an impenetrable outer protective zone formed by a hard outer shell, the outer shell including a plurality of apertures; an anchor zone formed by a hard inner shell; an inner zone formed by a padded inner liner functionally attached to the hard inner shell; and, an elastomeric zone formed by a plurality of leaf springs positioned between the outer shell and the inner shell. Each of the plurality of leaf springs includes at least one elastic member and an anchor point. Additionally, the helmet may include an intermediate shell contacting the padded inner liner and enclosing a quantity of cushioning pieces. Furthermore, a plurality of elastomeric cords may be present that connect the inner shell and outer shell passing through any intermediate structures. The elastomeric cords may have uniform thickness and/or thick and thin portions in the same individual cord.

In an additional alternate embodiment, the present invention includes an articulated protective helmet comprising a hard outer shell having at least two parts, said at least two parts each joined by an articulating means; an ear aperture in two of the at least two parts; a plurality of protective pads attached to an inner surface of the hard outer shell; and a locking means to releasably lock the articulated helmet in a closed position.

In a further additional embodiment, the present invention includes a protective helmet having multiple protective zones comprising: an inner shell having a first inner surface and a first outer surface; a padded inner lining attached to said first inner surface; a hard outer shell having second inner surface and a second outer surface, said hard outer shell functionally attached to said inner shell: an elastomeric zone between said first outer surface and said second inner surface; and, a plurality of sinusoidal springs positioned in said elastomeric zone.

One object of the invention is to provide a helmet that will direct linear and rotational forces away from the braincase.

A second object of the invention is to supply a helmet that includes an outer shell that floats or is suspended above the inner shell.

A third object of the invention is to offer a helmet with a sliding connection between the inner and outer shells.

An additional object of the invention is to supply a helmet that includes a crumple zone to absorb forces before they reach the braincase of the user.

An additional object of the invention is to offer a helmet with a capacity to measure the force of a blow received by the helmet.

A further object of the invention is to provide a helmet that is comfortable to put on while providing the protection of a helmet with a snug fit.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

Figure 1:
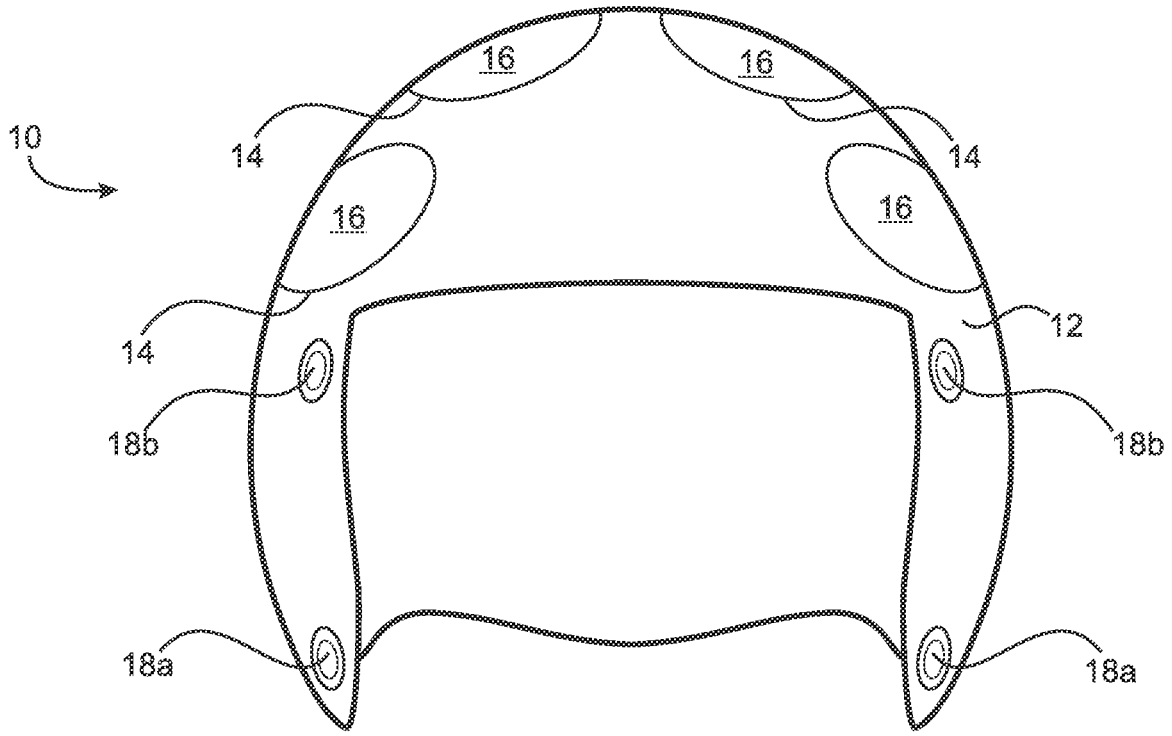
FIG. 1 is a front view of the double shell helmet ("helmet") of the present invention.

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims.

Although any methods, devices or materials similar or equivalent to those described herein can be used in the practice or testing of the invention, the preferred methods, devices, and materials are now described. It should be appreciated that the term "proximate" is synonymous with terms such as "nearby", "close", "adjacent", "neighboring", "immediate", "adjoining", etc., and such terms may be used interchangeably as appearing in the specification and claims.

In the present invention, a helmet is presented that includes multiple protective zones formed in layers over the user's skull or braincase. The outer protective zone is formed by an outer shell that "floats" or is suspended on the inner shell such that rotational force applied to the outer shell will cause it to rotate, or translate around the inner shell rather than immediately transfer such rotational or translational force to the skull and brain.

In one embodiment, the inner shell and outer shell are connected to each other by elastomeric cords that serve to limit the rotation of the outer shell on the inner shell and to dissipate energy by virtue of elastic deformation rather than passively transferring rotational force to the brain as with existing helmets. In effect, these elastomeric cords function like mini bungee cords that dissipate both angular and linear forces through a mechanism known as hysteretic damping i.e. when elastomeric cords are deformed, internal friction causes high energy losses to occur. These elastomeric cords are of particular value in preventing so called contrecoup brain injury.

The outer shell, in turn floats on the inner shell by virtue of one or more force absorbers or deflectors such as, for example, fluid filled bladders, leaf springs, or sinusoidal springs, located between the inner shell and the outer shell. To maximize the instantaneous reduction or dissipation of a linear and/or angular force applied to the outer shell, the fluid filled bladders interposed between the hard inner and outer shells may be intimately associated with, that is located under, one or more apertures in the outer shell with the apertures preferably being covered with elastomeric diaphragms and serving to dissipate energy by bulging outward against the elastomeric diaphragm whenever the outer shell is accelerated, by any force vector, toward the inner shell. Alternatively, the diaphragms could be located internally between inner and outer shells, or at the inferior border of the inner and outer shells, if it is imperative to preserve surface continuity in the outer shell. This iteration would necessitate separation between adjacent bladders to allow adequate movement of associated diaphragms.

In existing fluid filled designs, when the outer shell of a helmet receives a linear force that accelerates it toward the inner shell, the interposed gas or fluid is compressed and displaced. Because gas and especially fluid is not readily compressible, it passes the force passively to the inner shell and hence to the skull and the brain. This is indeed the very mechanism by which existing fluid filled helmets fail. The transfer of force is hydraulic and essentially instantaneous, negating the effectiveness of viscous fluid transfers as a means of dissipating concussive force.

Because of the elastomeric diaphragms in the present invention, any force imparted to the outer shell will transfer to the gas or liquid in the bladders, which in turn will instantaneously transfer the force to the external elastomeric diaphragms covering the apertures in the outer shell. The elastomeric diaphragms in turn will bulge out through the aperture in the outer shell, or at the inferior junction between inner and outer shells thereby dissipating the applied force through elastic deformation at the site of the diaphragm rather than passively transferring it to the padded lining of the inner shell. This process directs energy away from the brain and dissipates it via a combination of elastic deformation and tympanic resonance or oscillation. By oscillating, an elastic diaphragm employs the principle of hysteretic damping over and over, thereby maximizing the conversion of kinetic energy to low level heat, which in turn is dissipated harmlessly to the surrounding air.

Furthermore, the elastomeric springs or cords that bridge the space holding the fluid filled bladders (like the arachnoid membrane in the brain) serve to stabilize the spatial relationship of the inner and outer shells and provide additional dissipation of concussive force via the same principle of elastic deformation via the mechanism of stretching, torsion and even compression of the elastic cords.

By combining the bridging effects of the elastic springs or cords as well as the elastomeric diaphragms strategically placed at external apertures, both linear and rotational forces can be effectively dissipated.

In an alternate embodiment, leaf springs may replace fluid-filled bladders as a force absorber/deflector. Leaf springs may be structured as a fully elliptical spring or, preferably, formed in a parabolic shape. In both forms, the leaf spring is anchored at a single point to either the outer shell or, preferably, the hard inner shell and extend into the zone between the outer shell and inner shell. The springs may have a single leaf (or arm) or comprise a plurality of arms arrayed radially around a common anchor point. Preferably, each arm tapers from a thicker center to thinner outer portions toward each end of the arm. Further, the ends of each arm may include a curve to allow the end to more easily slide on the shell opposite the anchoring shell. In contrast to the use of leaf springs in vehicles, the distal end of the spring arms are not attached to the nonanchoring or opposite shell. This allows the ends to slide on the shell to allow independent movement of each shell when the helmet is struck by rotational forces. This also enables the frictional dissipation of energy. Preferably, the distal ends contact the opposite shell in the neutral condition, that is, when the helmet is not in the process of being struck.

When the elastomeric cords are used in conjunction with the leaf springs, the orientation of the cords will be similar to their use with the fluid-filled bladders/diaphragm embodiment, but will be utilized to absorb rotational forces as the leaf springs will handle the liner forces more directly.

Henceforth, my design, by employing elastomeric cords and diaphragms can protect against concussion as well as so called coup and contrecoup brain injury and torsional brain injury which can cause subdural hematoma by tearing of bridging veins or injury to the brain stem through twisting of the stem about its central axis.

Figure 2:
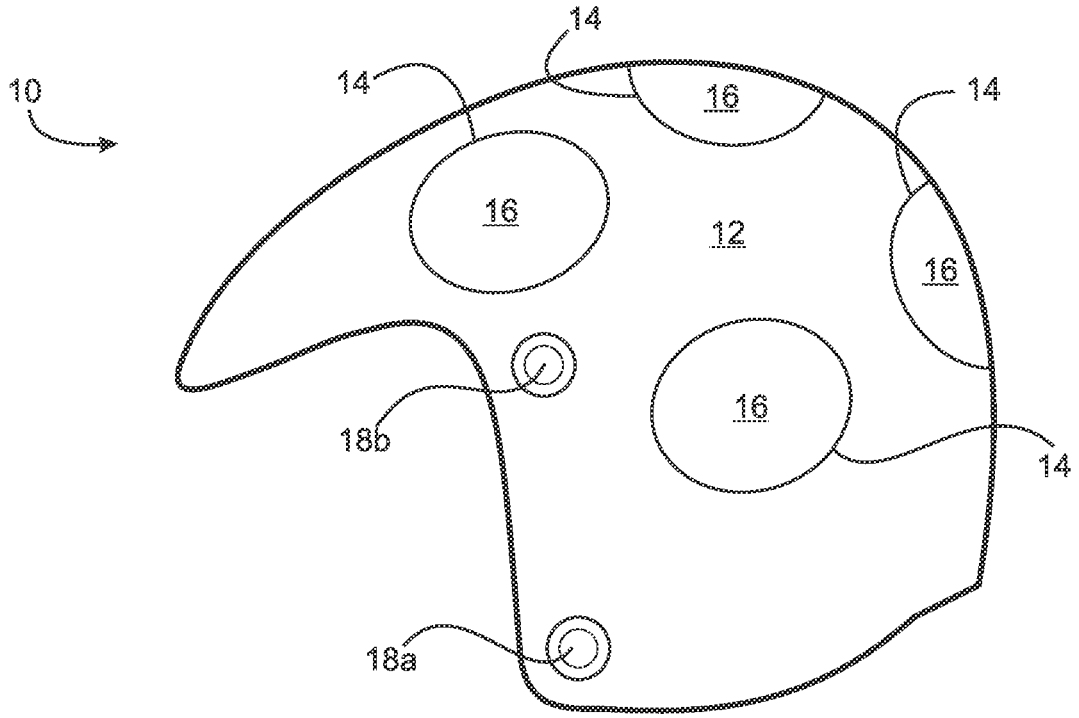
FIG. 2 is a side view of the helmet showing two face protection device attachments on one side of the helmet.

Adverting to the drawings, FIG. 1 is a front view of multiple protective zone helmet 10 ("helmet 10"). The outer protective zone is formed by outer shell 12 and is preferably manufactured from rigid, impact resistant materials such as metals, plastics such as polycarbonates, ceramics, composites and similar materials well known to those having skill in the art. Outer shell 12 defines at least one and preferably a plurality of apertures 14. Apertures 14 may be open but are preferably covered by a flexible elastomeric material in the form of diaphragm 16. In a preferred embodiment, helmet 10 also includes several face protection device attachments 18. In a more preferred embodiment, face protection device attachments 18 are fabricated from a flexible elastomeric material to provide flexibility to the attachment. The elastomeric material reduces the rotational pull on helmet 10 if the attached face protection device (not seen in FIG. 1) is pulled. By elastomeric is meant any of various substances resembling rubber in properties, such as resilience and flexibility. Such elastomeric materials are well known to those having skill in the art. FIG. 2 is a side view of helmet 10 showing two face protection device attachments 18*a* and 18*b* on one side of the helmet. Examples of face protection devices are visors and face masks. Such attachments can also be used for chin straps releasably attached to the helmet in a known manner.

Figure 3A:
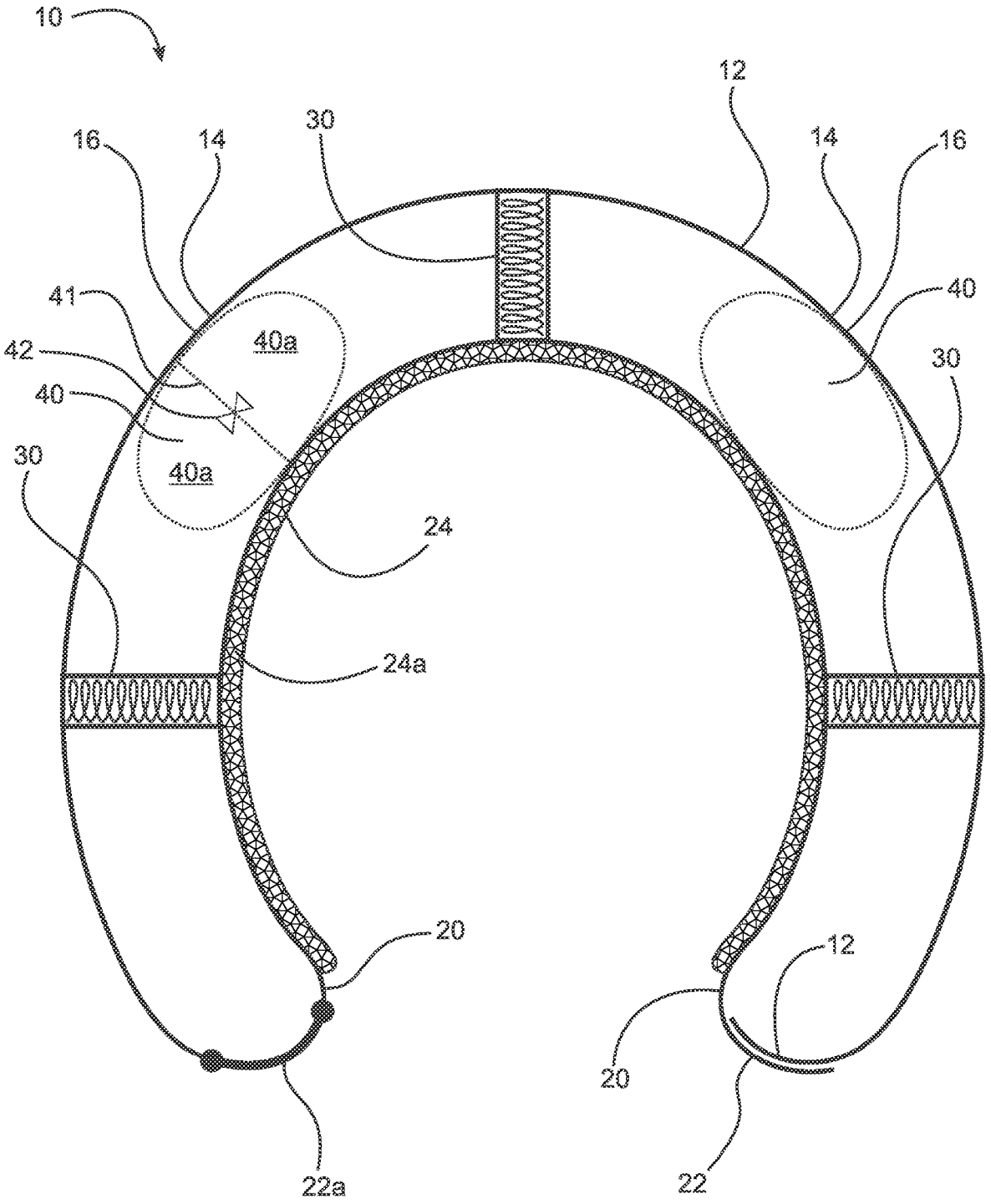
FIG. 3A is a cross section view of the helmet showing the inner shell and the elastomeric cords connecting the two shells.

FIG. 3A is a cross section view of helmet 10 showing the hard inner shell 20 and the elastomeric springs or cords 30 ("cords 30") that extend through an elastomeric zone connecting the two shells. Inner shell 20 forms an anchor zone and is preferably manufactured from rigid, impact resistant materials such as metals, plastics such as polycarbonates, ceramics, composites and similar materials well known to those having skill in the art. Inner shell 20 and outer shell 12 are slidingly connected at sliding connection 22. By slidingly connected is meant that the edges of inner shell 20 and outer shell 12, respectively, slide against or over each other at connection 22. In an alternate embodiment, outer shell 12 and inner shell 20 are connected by an elastomeric element, for example a u-shaped elastomeric connector 22*a* ("connector 22*a*"). Sliding connection 22 and connector 22*a* each serve to both dissipate energy and maintain the spatial relationship between outer shell 12 and inner shell 20.

Cords 30 are flexible cords, such as bungee cords or elastic "hold down" cords or their equivalents used to hold articles on car or bike carriers. This flexibility allows outer shell 12 to move or "float" relative to inner shell 20 and still remain connected to inner shell 20. This floating capability is also enabled by the sliding connection 22 between outer shell 12 and inner shell 20. In an alternate embodiment, sliding connection 22 may also include an elastomeric connection 22*a* between outer shell 12 and inner shell 20. Padding 24 forms an inner zone and lines the inner surface of inner shell 20 to provide a comfortable material to support helmet 10 on the user's head. In one embodiment, padding 24 may enclose a loose cushioning pieces such as STYROFOAM® beads 24*a* or "peanuts" or loose oatmeal.

Also seen in FIG. 3A is a cross section view of bladders 40 situated in the elastomeric zone between outer shell 12 and inner shell 20. Helmet 10 includes at least one and preferably a plurality of bladders 40. Bladders 40 are filled with fluid, either a liquid such as water or a gas such as helium or air. In one preferred embodiment, the fluid is helium as it is light and its use would reduce the total weight of helmet 10. In an alternate embodiment, bladders 40 may also include compressible beads or pieces such as STYROFOAM® beads. Bladders 40 are preferably located under apertures 14 of outer shell 12 and are in contact with both inner shell 20 and outer shell 12. Thus, if outer shell 12 is pressed in toward inner shell 20 and the user's skull during a collision, the fluid in one or more of bladders 40 will compress and squeeze bladder 40, similar to squeezing a balloon. Bladder 40 will bulge toward aperture 14 and displace elastomeric diaphragm 16. This bulging-displacement action diverts the force of the blow from the user's skull and brain up toward the aperture providing a new direction for the force vector. Bladders 40 may also be divided internally into compartments 40*a* by bladder wall 41 such that if the integrity of one compartment is breached, the other compartment will still function to dissipate linear and rotational forces. Valve(s) 42 may also be included between the compartments to control the fluid movement.

Figure 3B:
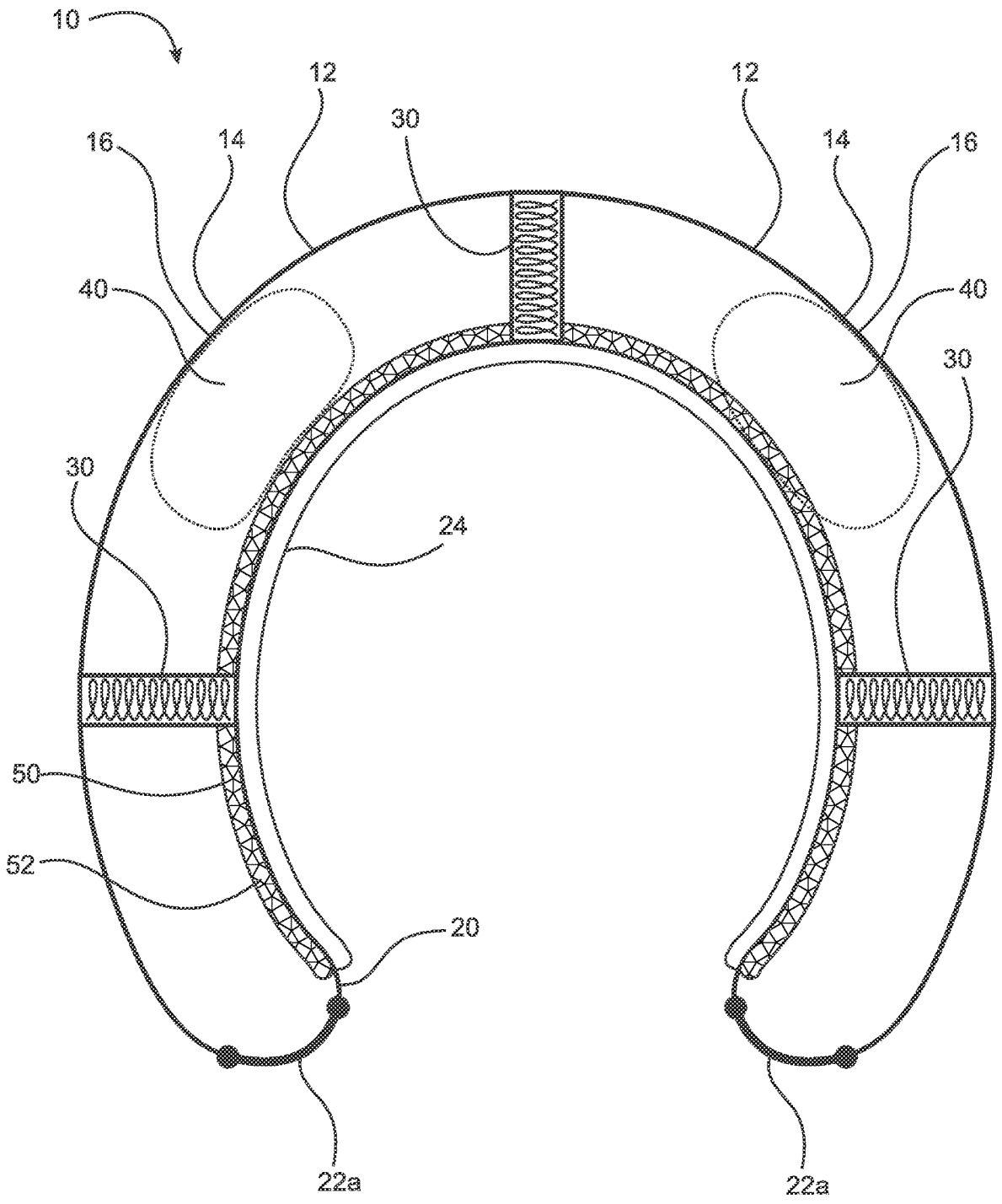
FIG. 3B is a cross section view similar to FIG. 3 depicting an alternate embodiment of the helmet to include an intermediate shell enclosing cushioning pieces.

FIG. 3B is a cross section view similar to FIG. 3 discussed above depicting an alternate embodiment of helmet 10. Helmet 10 in FIG. 3B includes a crumple zone formed by intermediate shell 50 located between outer shell 12 and inner shell 20. In the embodiment shown, intermediate shell 50 is close to or adjacent to inner shell 20. As seen in FIG. 3B, intermediate shell 50 encloses filler 52. Preferably, filler 52 is a compressible material that is packed to deflect the energy of a blow to protect the skull, similar to a "crumple zone" in a car. The filler is designed to crumple or deform, thereby absorbing the force of the collision before it reaches inner pad 24 and the brain case. In this embodiment, it can be seen that cords 30 extend from inner shell 20 to outer shell 12 through intermediate shell 50. One suitable tiller 52 is STYROFOAM® beads or "peanuts" or equivalent material such as is used in packing objects. Because of its "crumpling" function, intermediate shell 50 is preferably constructed with a softer or more deformable materials than outer shell 12 or inner shell 20. Typical fabrication material for intermediate shell 50 is a stretchable material such as latex or spandex or other similar elastomeric fabric that preferably encloses filler 52.

Figure 3C:
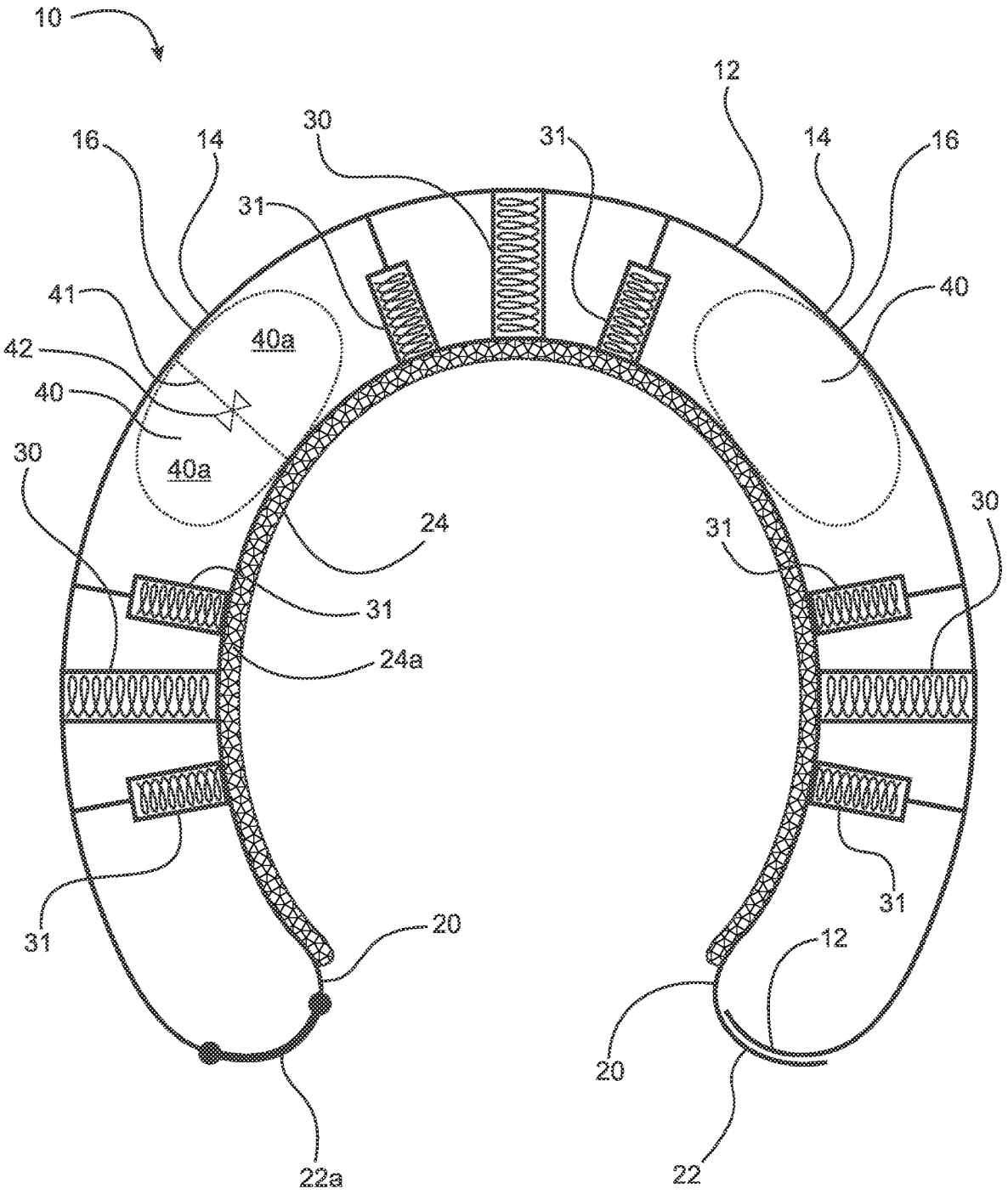
FIG. 3C is a cross section view similar to FIG. 3A depicting an alternate embodiment of the elastomeric cords in which some of the elastomeric cords have thin and thick portions.

FIG. 3C is a cross section view similar to FIG. 3A depicting an alternate embodiment of helmet 10 in which elastomeric cords 31 ("cords" 31) have thin and thick portions. In the embodiment shown, the thick elastomeric portions may be anchored on either the inner surface of outer shell 12 or outer surface of inner shell 20. Similarly, the thin is nonelastomeric portions of cords 31 may be attached to either the inner surface of outer shell 12 or the outer surface of inner shell 20. The thin elastomeric portions may be a single or multiply cord.

Figure 4:
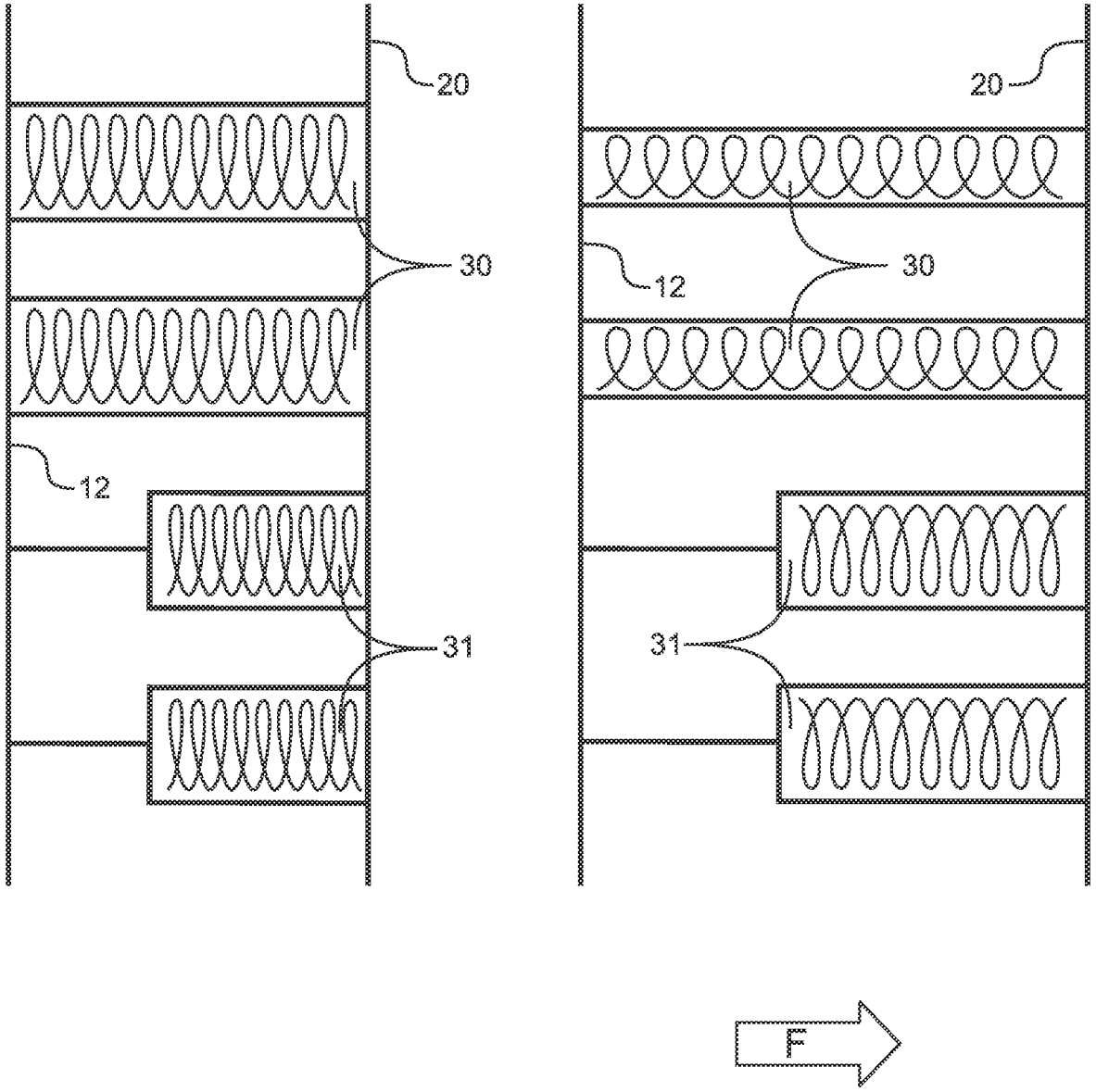
FIG. 4 is a schematic view of both types of cords in both a neutral position and in maximal deployment when the helmet is hit with greater than normal force.

FIG. 4 is a schematic view of cords 31 in a neutral position and in maximal deployment when helmet 10 is hit with greater than normal force. Also seen are cords 30 which have uniform thickness throughout their lengths. In the neutral position on the left of FIG. 4, cords 30 are under slight tension while cords 31 are under not tension. As seen on the right of FIG. 4, under maximal displacement of outer shell 12 relative to inner shell 20, cords 30 may be stretched close or up to its elastic limit, but the thin portion of cord 31 has now engaged the thicker portion to mitigate the large force striking helmet 10 and to prevent any loss of elasticity in cord 30. By using cord 31 as a backup for blows struck with severe force, greater protection can be achieved even after the cord 30 reaches its elastic limit and does not interfere with absorbing, the any rotational force striking helmet 10. For this reason, cord(s) 31 will act to preserve the integrity of the cord system of helmet 10.

Figure 5A:
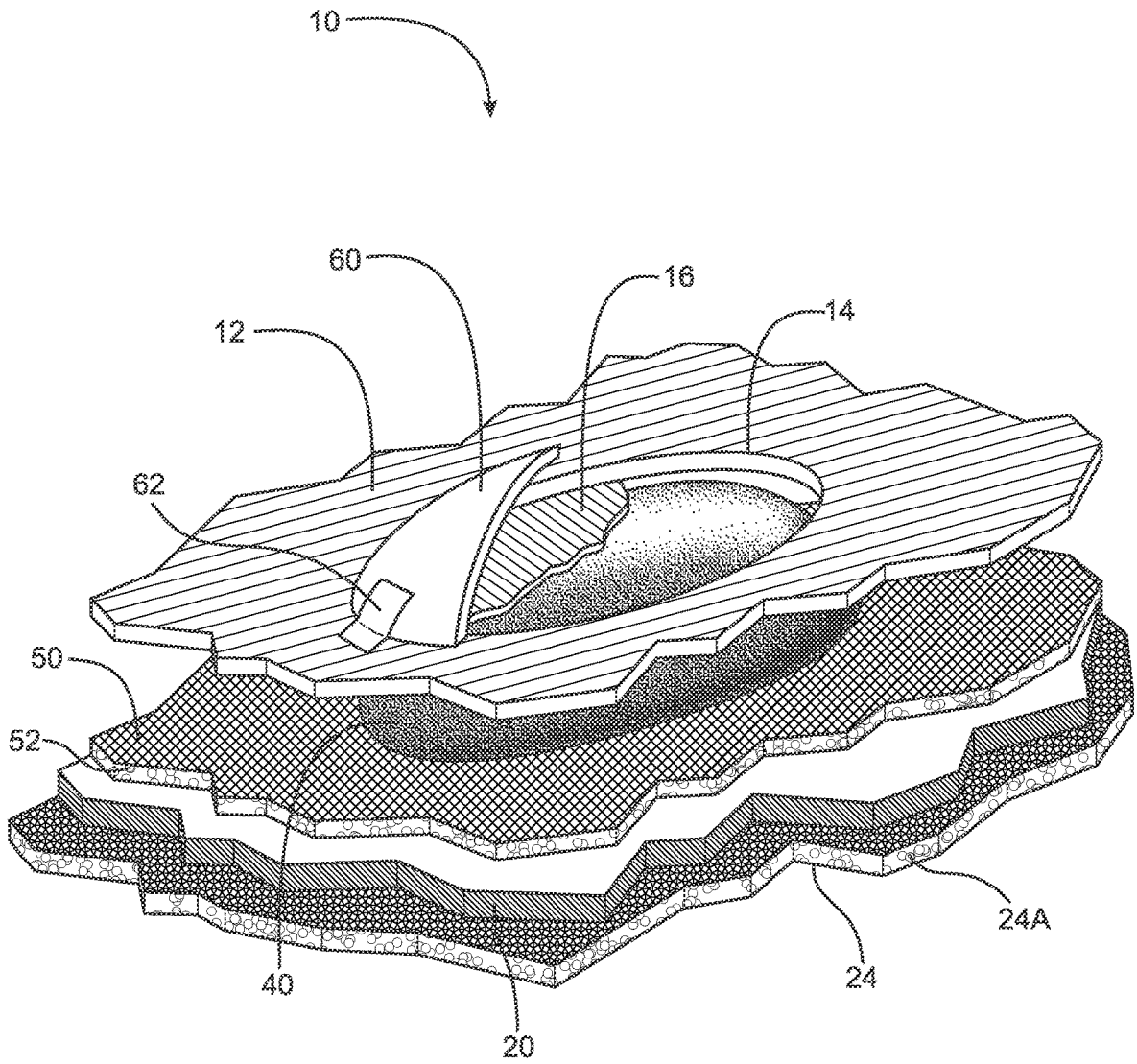
FIG. 5A is a top perspective view of one section of the outer shell of the helmet showing an alternate embodiment including a liftable lid that protect the diaphragms covering apertures in the outer shell of the helmet.
Figure 5B:
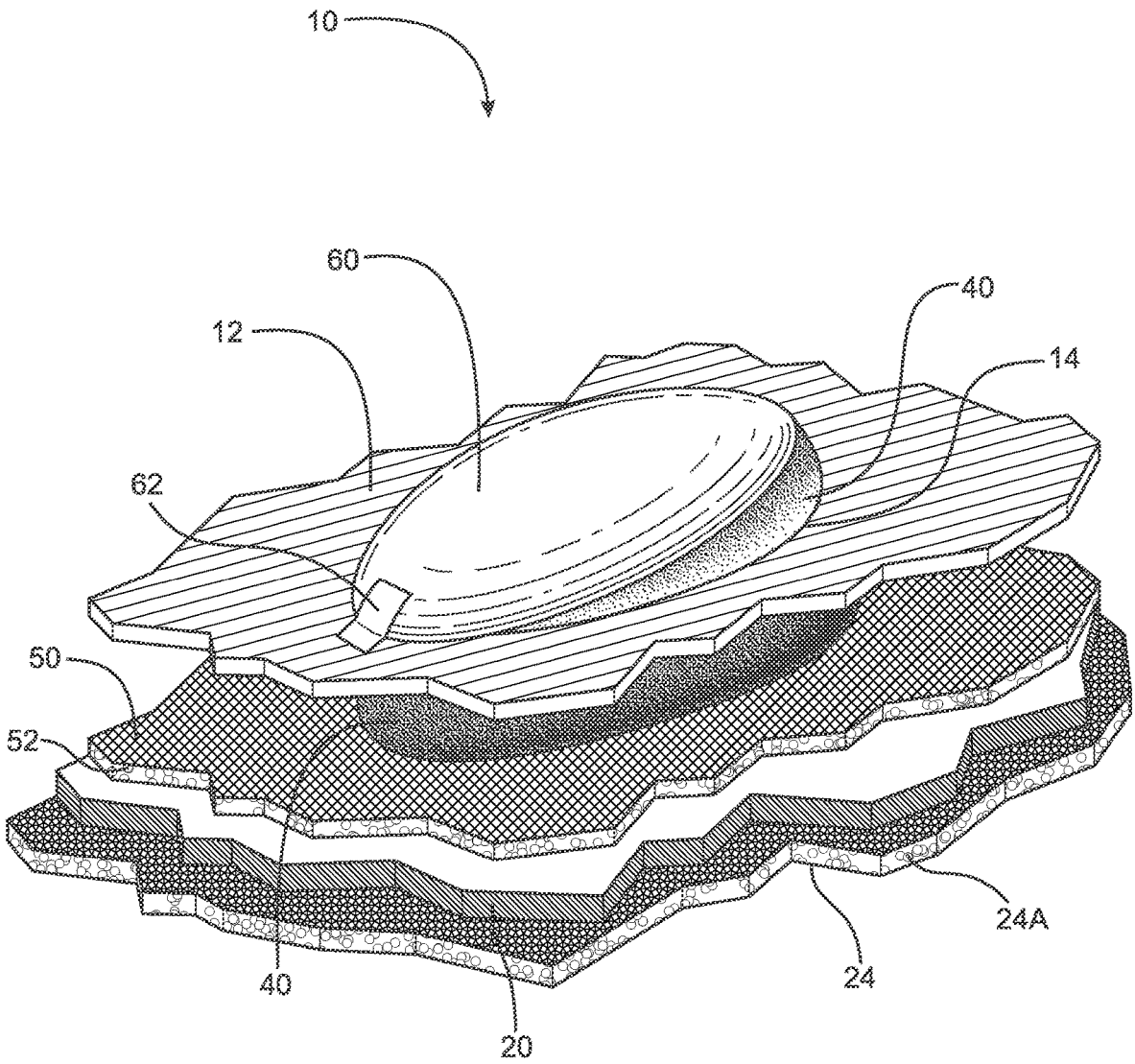
FIG. 5B is a the same view as FIG. 5A depicting the liftable lid protecting the bulging fluid-filled bladder.

FIG. 5A is a top view of one section of outer shell 12 of helmet 10 showing an alternate embodiment in which liftable lids 60 ("lid 60") are used to cover aperture 14 to shield diaphragm 16 and/or bladder 40 from punctures, rips, or similar incidents that may destroy their integrity. Lids 60 are attached to outer shell 12 by lid connector 62 ("connector 62") in such a way that they will lift or raise up if a particular diaphragm 16 bulges outside of aperture 14 due to the expansion of one or more bladders 40, exposing it to additional collisions. Because it is liftable, lid 60 allows diaphragm 16 to freely elastically bulge through aperture 14 above the surface of outer shell 12 to absorb the force of a collision, but still be protected from damage caused by external forces. In an alternate embodiment, diaphragm 16 is not used and lid 60 directly shields and protects bladder 40. In one embodiment, lids 60 are attached to outer shell 12 using hinges 62. In an alternate embodiment, lids 60 are attached using flexible plastic attachment 62. FIG. 5B depicts liftable lid 60 protecting bladder 40 as it bulges above outer shell 12.

Figure 6A:
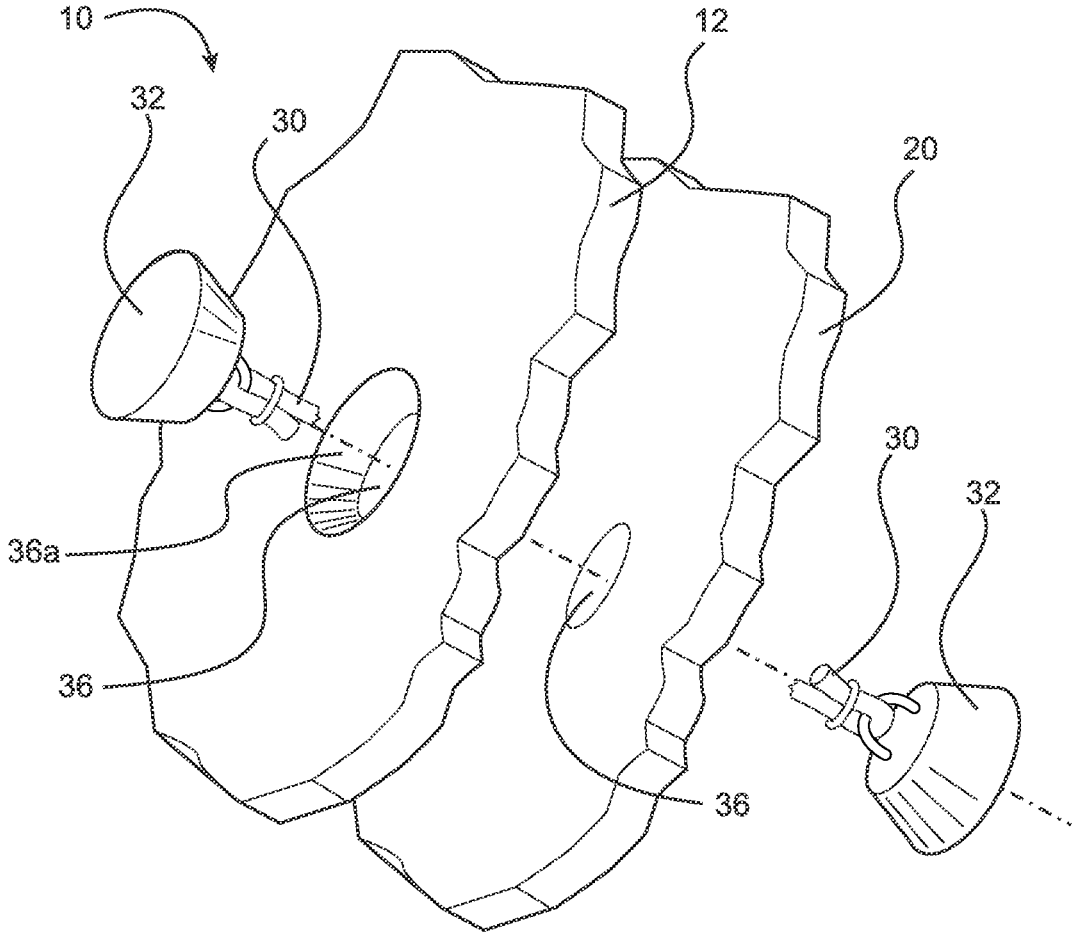
FIG. 6A is an exploded view showing the attachment of the cord to both the inner shell and outer shell to enable the outer shell to float around the inner shell; and, FIG. 6B is a cross section of the completed attachment fitting with the elastomeric cord attached to two plugs and extending between the outer shell and the inner shell of the helmet.

FIG. 6A is an exploded view showing one method cord 30 is attached to helmet 10 to enable outer shell 12 to float over inner shell 20. Cavities 36, preferably with concave sides 36*a*, are drilled or otherwise placed in outer shell 12 and inner shell 20 so that the holes are aligned. Each end of cord 30 is attached to plugs 32 which are then placed in the aligned holes. In one embodiment, plugs 32 are held in cavities 36 using suitable adhesives known to those skilled in the art. In an alternate embodiment, plugs 32 are held in cavities 36 with a friction fit or a snap fit.

Figure 6B:
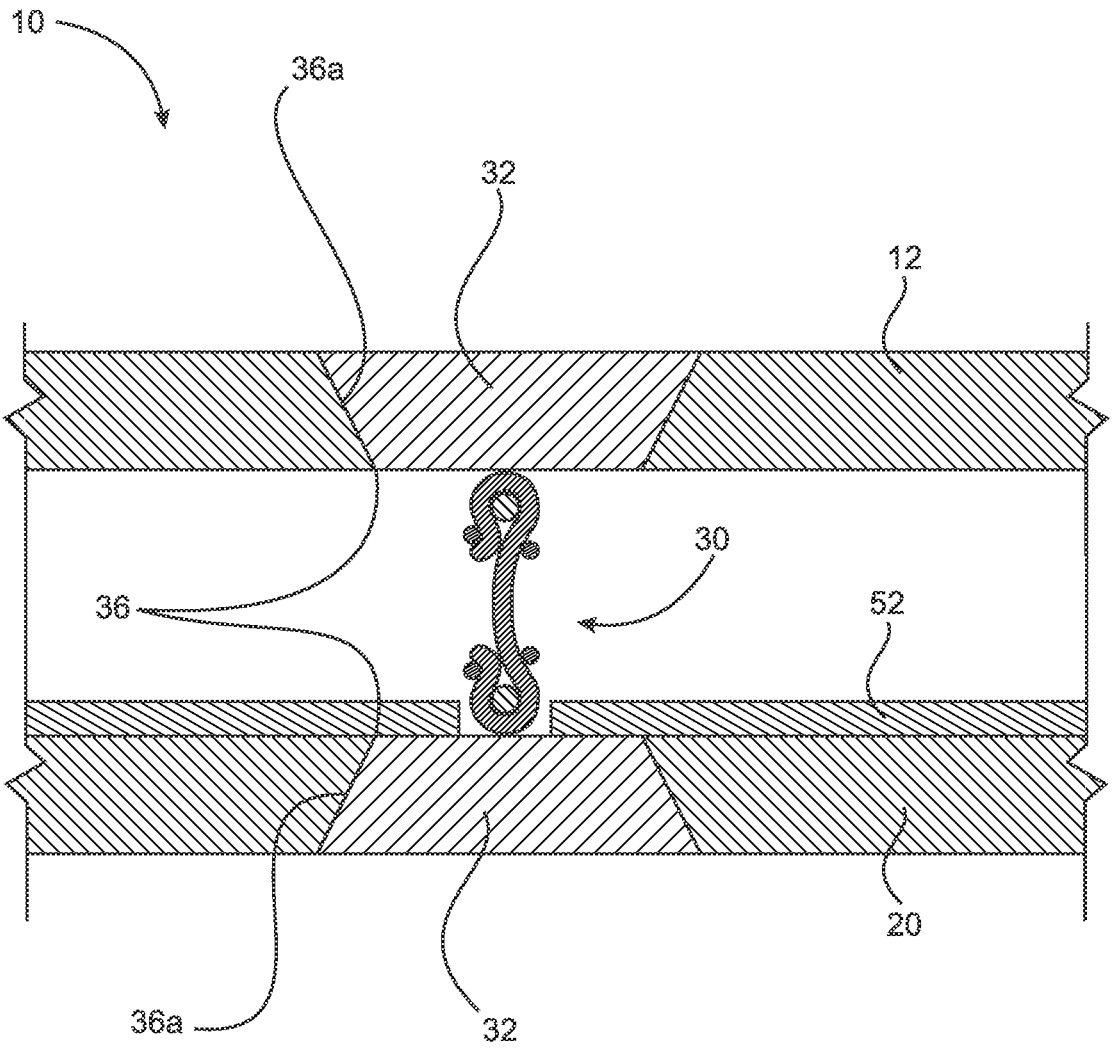

FIG. 6B is a cross section of the completed fitting in which cord 30 is attached to two plugs 32 and extends between outer shell 12 and inner shell 20. Also seen is intermediate shell 50 enclosing filler 52. Not seen are bladders 40 which would be situated between intermediate shell 50 (or inner shell 20) and outer shell 12. Persons of skill in the art will recognize that cords 31 may be attached between outer shell 12 and inner shell 20 in a similar manner.

Figure 7:
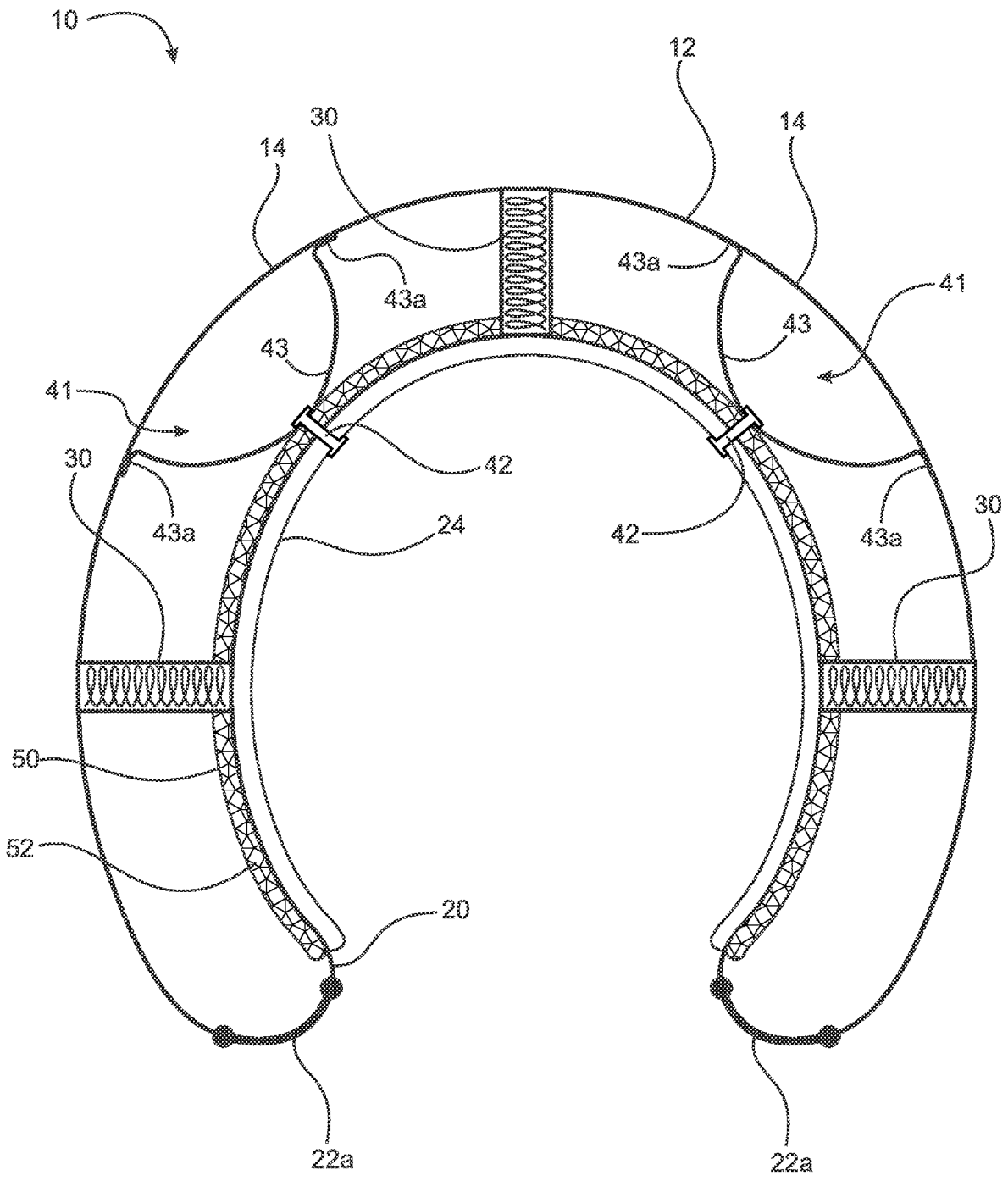
FIG. 7 is a cross section view of an alternate embodiment of the helmet of the present invention in which the fluid-filled bladders are replaced as force absorbers/deflectors by parabolic leaf springs.
Figure 7A:
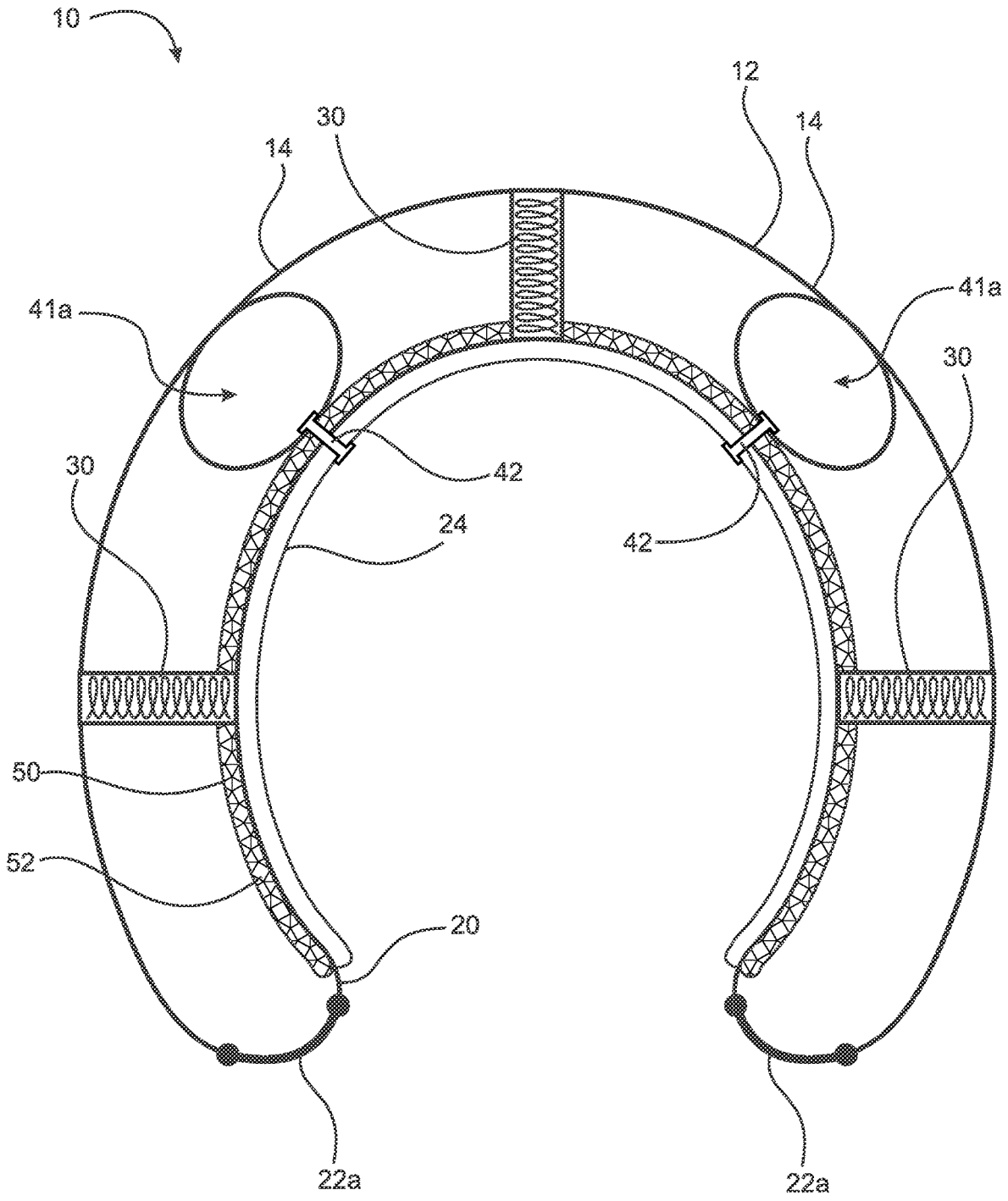
FIG. 7A is a cross section view of an alternate embodiment of the helmet of the present invention in which the fluid-filled bladders are replaced as force absorbers/deflectors by elliptical leaf springs.

FIG. 7 is a cross section view of an alternate embodiment of helmet 10 in which bladders 40 are replaced as force absorbers/deflectors with parabolic leaf springs 41 ("springs 41"). In the embodiment shown, springs 41 are anchored onto inner shell 20 at anchor point 42. Springs 41 include at least one arm 43 with two ends 43*a* which are preferably shaped into a curve as shown. Arms 43 are preferably tapered having a thicker center portion near anchor point 42 and gradually thinning in width and/or thickness towards ends 43*a*. In addition, arms 43 may be laminated with gradually fewer elastic layers applied more distally from anchor point 42. A plurality of arms 43 may be arrayed radially around and attached to a single anchor point 42. As seen in FIG. 7, arms 43 extend through crumple zone 50, if present. Leaf springs 41 may also be used with elastomeric cords 30. FIG. 7A is an alternate embodiment in which elliptical leaf springs 41*a* ("springs 41*a*"), also attached at a single anchor point 42 are used in place of parabolic leaf springs 41.

Figure 8:
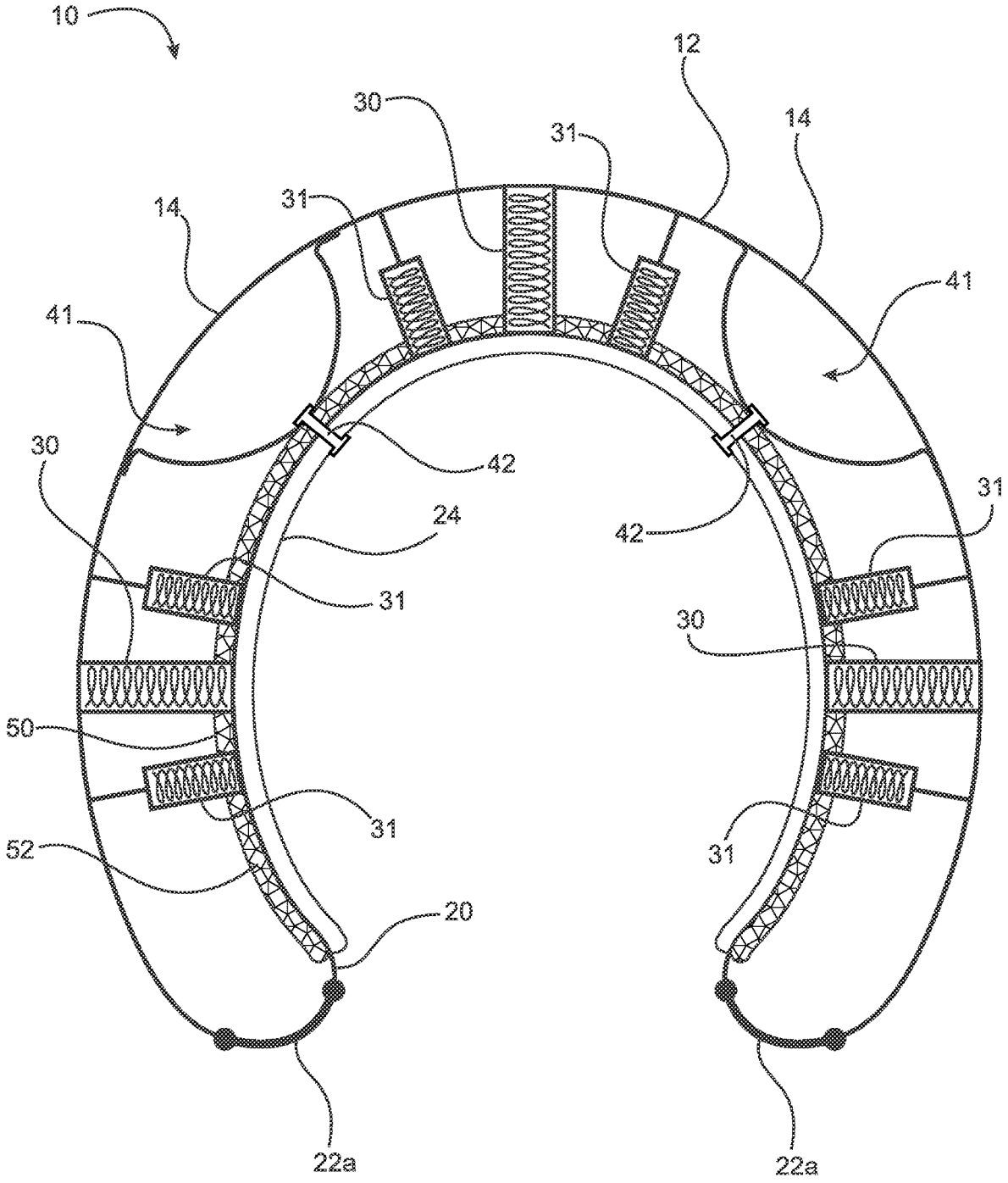
FIG. 8 is a cross section of the alternate embodiment of the protective helmet shown in FIG. 7 showing the use of the leaf springs with both types of elastomeric cords.

FIG. 8 is a cross section of the alternate embodiment of helmet 10 shown in FIG. 7 showing the use of leaf springs 41 with both elastomeric cords 30 and cords 31. As described above, cords 31, whose thick portions are thicker than uniform cords 30, act as a backup to prevent cords 30 from being stretched beyond their elastic limit. As shown in FIG. 8, the thick portions may be attached to either outer shell 12 or inner shell 20.

Figure 9:
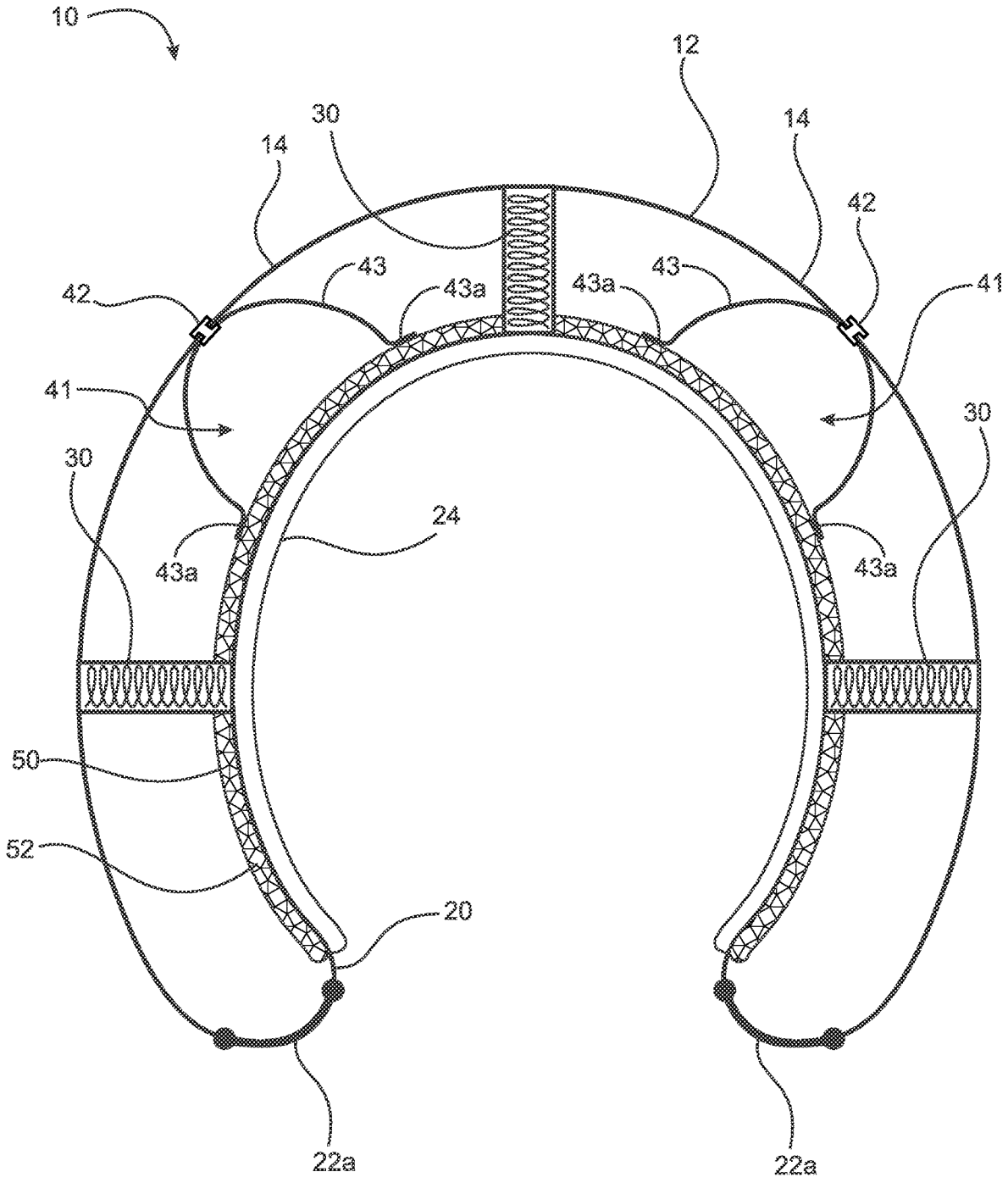
FIG. 9 is a cross section view of the helmet illustrating leaf springs anchored on the outer shell of the helmet.

FIG. 9 is a cross section view of helmet 10 illustrating leaf springs 41 anchored on outer shell 12 with cords 30. It is understood that cords 31 may also be used with this embodiment.

Figure 10A:
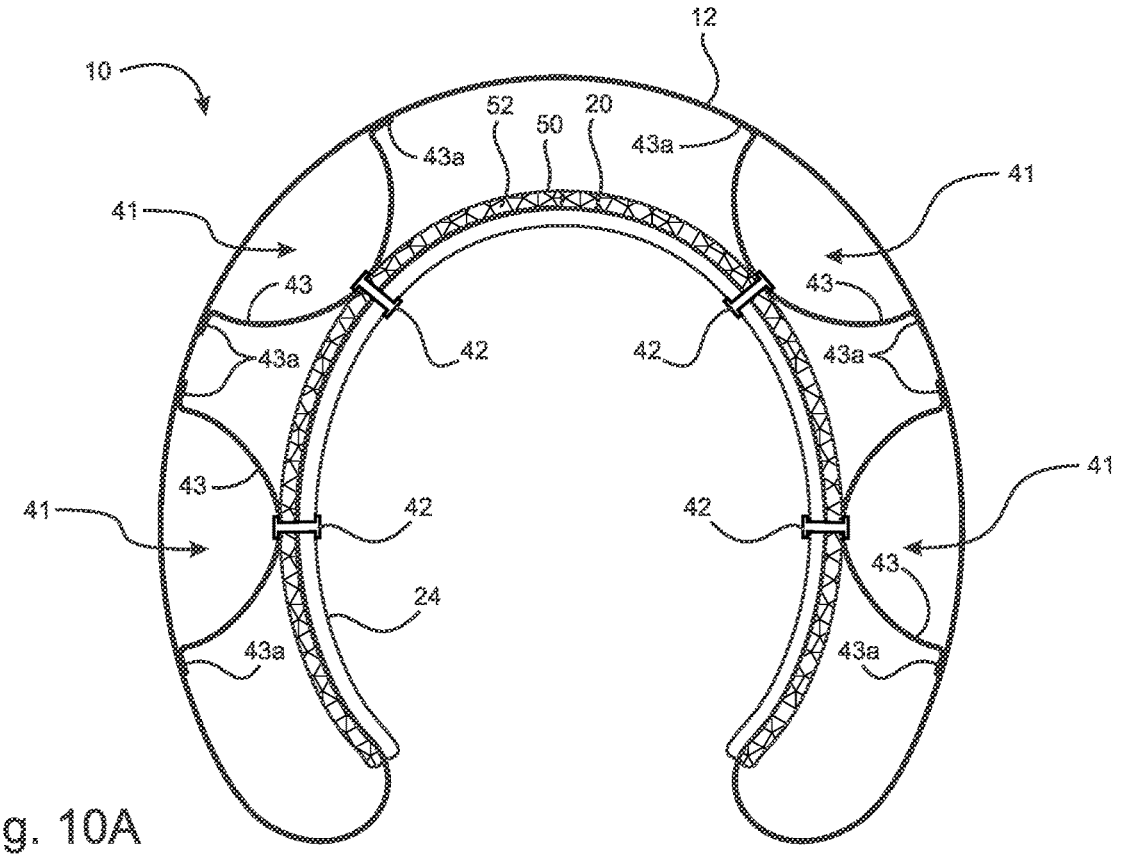
FIG. 10A depicts schematically the parabolic leaf springs when the helmet is in a neutral state before being struck by a force.
Figure 10B:
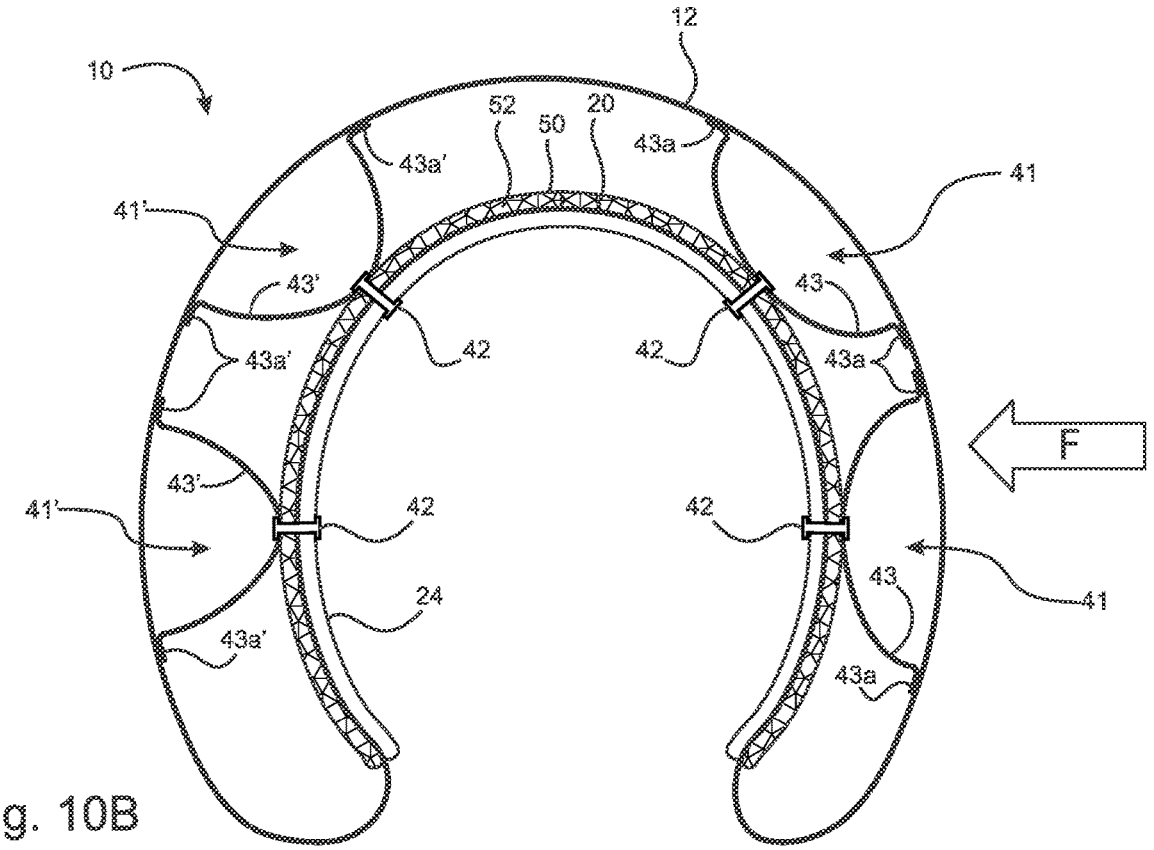
FIG. 10B depicts schematically how the parabolic leaf springs temporarily change their shape when absorbing a force striking the helmet.

FIGS. 10A and 10B depict schematically the action of leaf springs 41 when helmet 10 is struck by a force. In FIG. 10A, helmet 10 is in the neutral state. Springs 41 are shown in relatively slight tension on all sides of helmet 10. In FIG. 10B, force F strikes helmet 10 from the right hand side. Ends 43*a* are separated further from each other as arms 43 are pushed toward inner shell 20 to absorb the translational force vector created by force F. Simultaneously, ends 43*a*' of arms 43' of the springs 41' located on the opposite side of helmet 10 move closer together as the tension on arms 43' is reduced as the left side of outer shell 12 is temporarily moved away from inner shell 20. After force F is exhausted, the increased tension created on the arms 43 on the right hand or contact side of helmet 10 act to push outer shell 12 toward the neutral position. This is aided by the relaxed tension of arms 43' on the noncontact side of helmet 10 which enables that side of outer shell 12 to move into the neutral position closer to inner shell 20. Although not shown in FIGS. 10A and 10B, it will be understood that cords 30 and/or cords 31 will act to absorb any rotational force generated on helmet 10 by force F.

Figure 11:
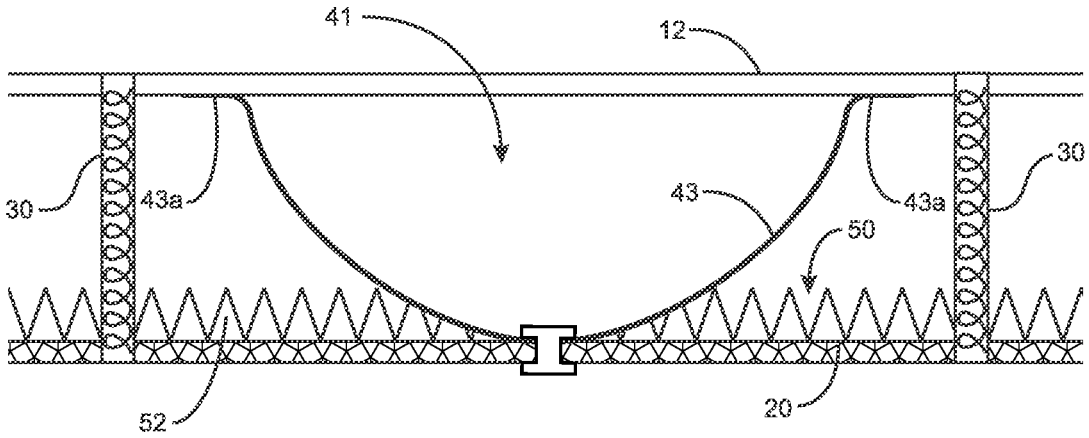
FIG. 11 is an enlarged schematic cross section of a crumple zone in a helmet in which a leaf spring is the force absorber/deflector.
Figure 12:
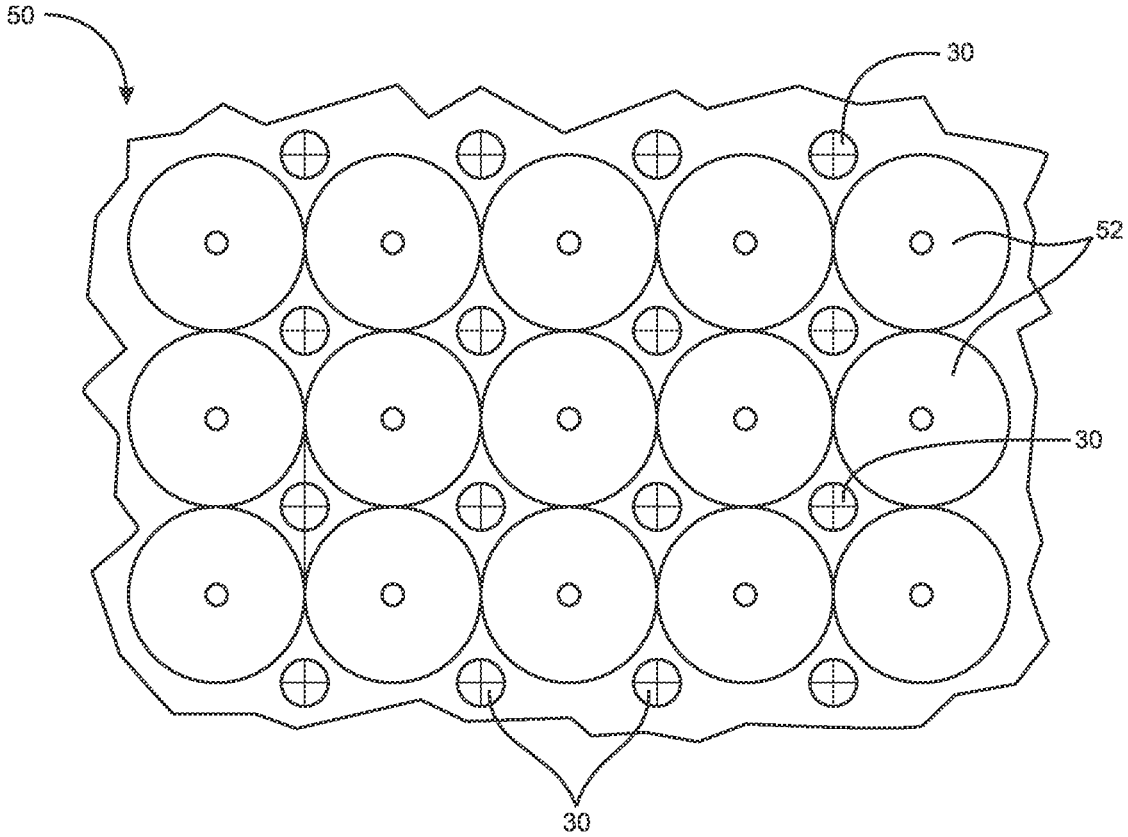
FIG. 12 is a top view of the crumple zone showing a plurality of elastomeric cords extending between the cones of the viscoelastic material.

FIG. 11 is an enlarged schematic cross section of the crumple zone 50 in helmet 10 in which leaf spring 41 is the force absorber/deflector. Elastomeric cords 30 extend from inner shell 20 to outer shell 12. Crumple zone 50 is seen between cords 30 and preferably comprises SORBOTHANE® or other viscoelastic materials 52. In the embodiment shown, the SORBOTHANE® is in the shape of cones. Viscoelastic materials provide the advantage of behaving like a quasi-liquid, being readily deformed by an applied force and slow to recover, although in the absence of such a force it takes up a defined shape and volume. An unusually high amount of the energy from an object dropped onto SORBOTHANE® is absorbed. Leaf spring 41 is seen anchored to inner shell 20 and extending up through crumple zone 50 and contacting outer shell 12. In this embodiment, cones 52 in crumple zone 50 acts to absorb a blow having much greater than normal force so that springs 41 are deflected to such a degree that outer shell reaches crumple zone 50. FIG. 12 is a top view of crumple zone 50 showing a plurality of cords 30 extending between the cones 52 of the viscoelastic material. It is understood that a helmet 10 employing fluid-filled bladders 40 may include a crumple zone 50 having viscoelastic materials 52 such as SORBOTHANE®.

Figure 13A:
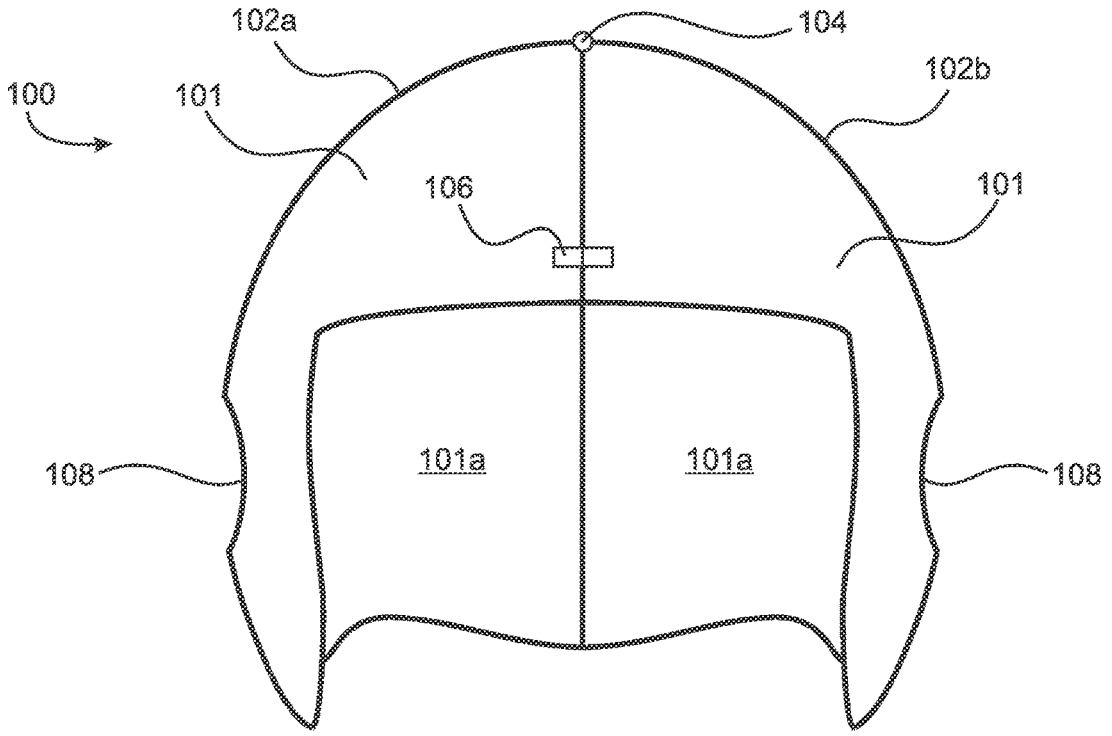
FIGS. 13A and 13B are front views of an articulating helmet in which is divided into at least two parts in which are attached by articulating means such as hinges or pivots.
Figure 13B:
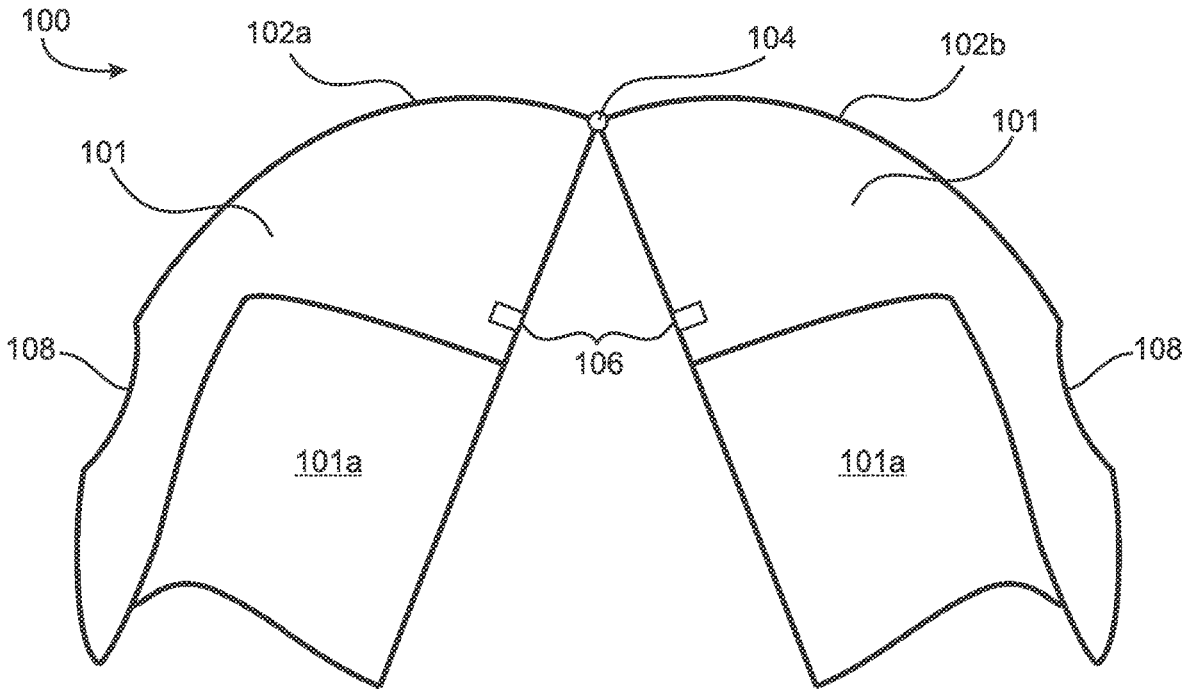

FIGS. 13A and 13B are front views of articulating helmet 100 ("helmet 100") which is divided into at least two parts that are attached by articulating means. By articulating is meant a helmet possesses parts or sections joined by articulating means such as hinge or pivot connections, swivels, or other devices that can allow separate parts of a helmet to be opened and closed together. Each section includes hard outer shell 101.

FIG. 13A shows helmet 100 in the closed and locked orientation. Sections 102*a* and 102*b* are joined by articulating means 104. In this embodiment, articulating means 104 is hinge 104. It will be recognized that more than one hinge 104 or other articulating means may be used to open and close helmet 100. Preferably helmet 100 includes at least one lock 106 to hold helmet 100 in the closed position. Ear apertures 108 are also shown along with inner surface 103.

FIG. 13B shows helmet 100 in the open orientation. Lock 106 is unlocked allowing hinge 104 to open separating sections 102*a* and 102*b*.

Figure 14A:
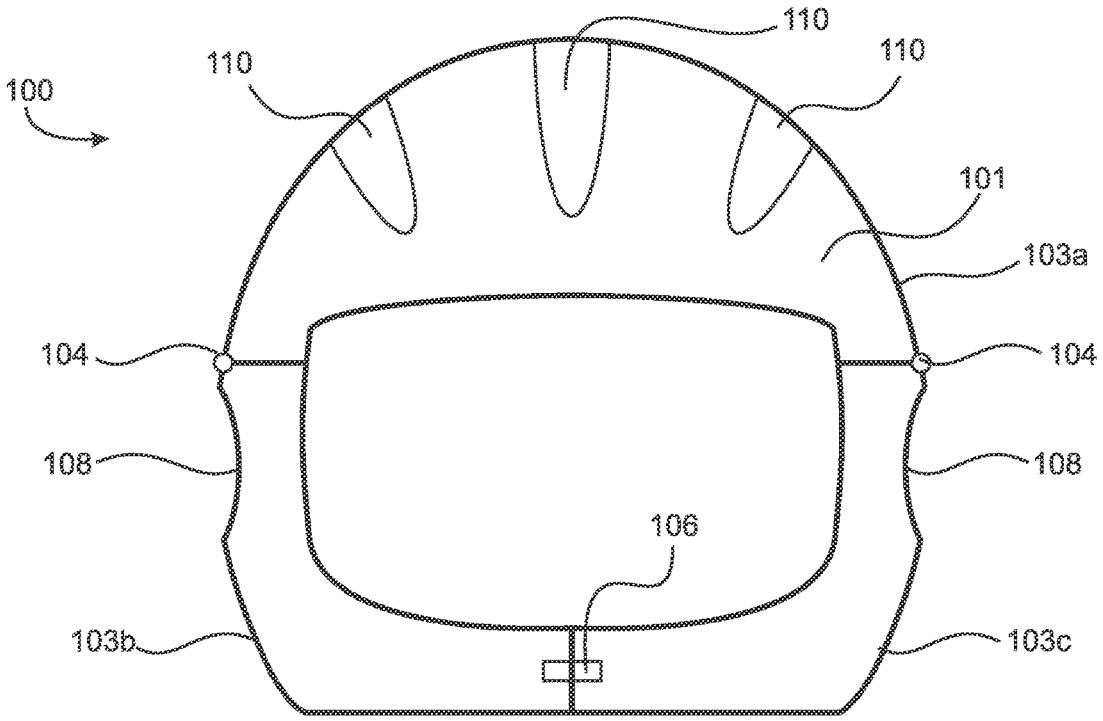
FIGS. 14A and 14B depict front views of an alternate embodiment of the articulating helmet of the present invention having three articulating sections.
Figure 14B:
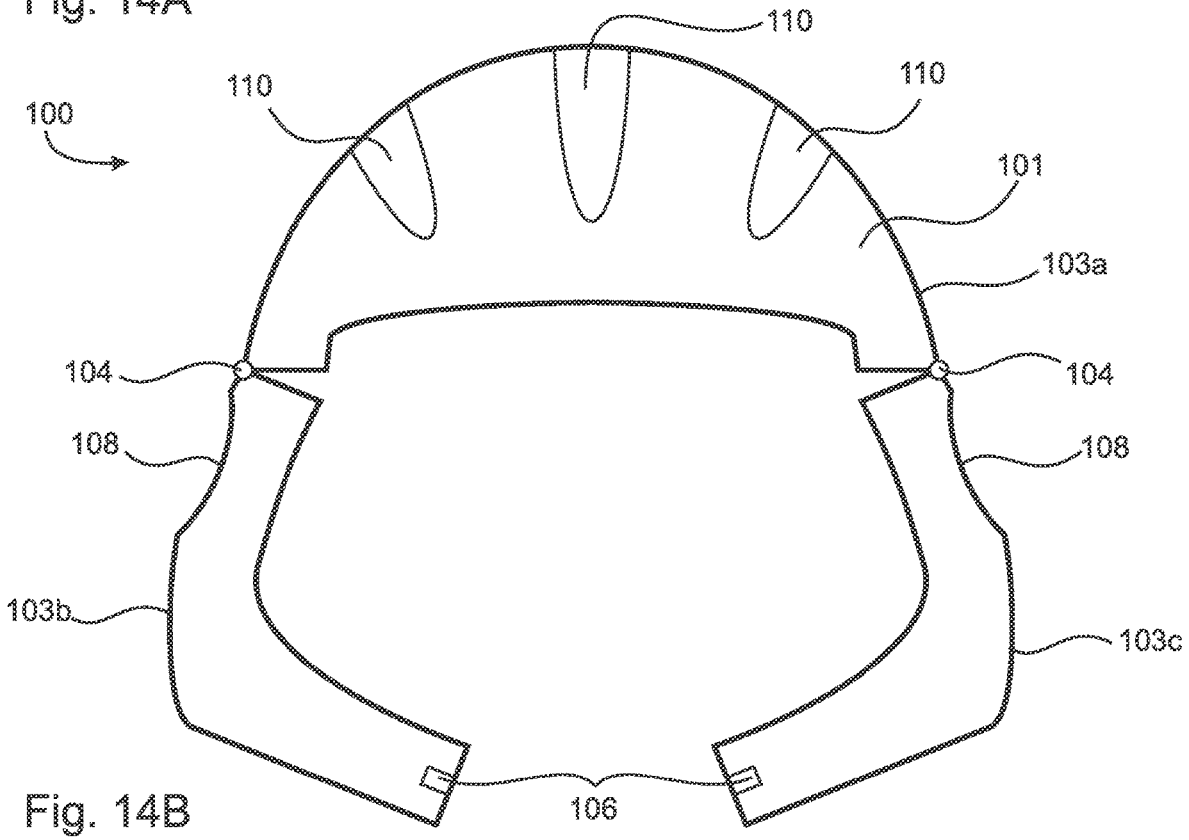

FIGS. 14A and 14B depict front views of an alternate embodiment of helmet 100 having three sections 103*a*, 103*b*, and 103*c*. In this embodiment, helmet 100 also includes air vents 110 which are openings extending from outer surface 101 through to inner surface 103 of helmet 100 and defined by helmet 100. Hinges 104 pivot to move sections 103*b* and 103*c* closed with section 103*a*. One or more locks 106 hold the sections in the closed position. It will be recognized that air vents 110 may be present in helmets with two or more than three sections such as seen in FIGS. 13A and 13B. FIG. 13B shows helmet 100 in the open position in which both hinges 104 open to separate sections 103*b* and 103*c* from section 103*a*.

Figure 15:
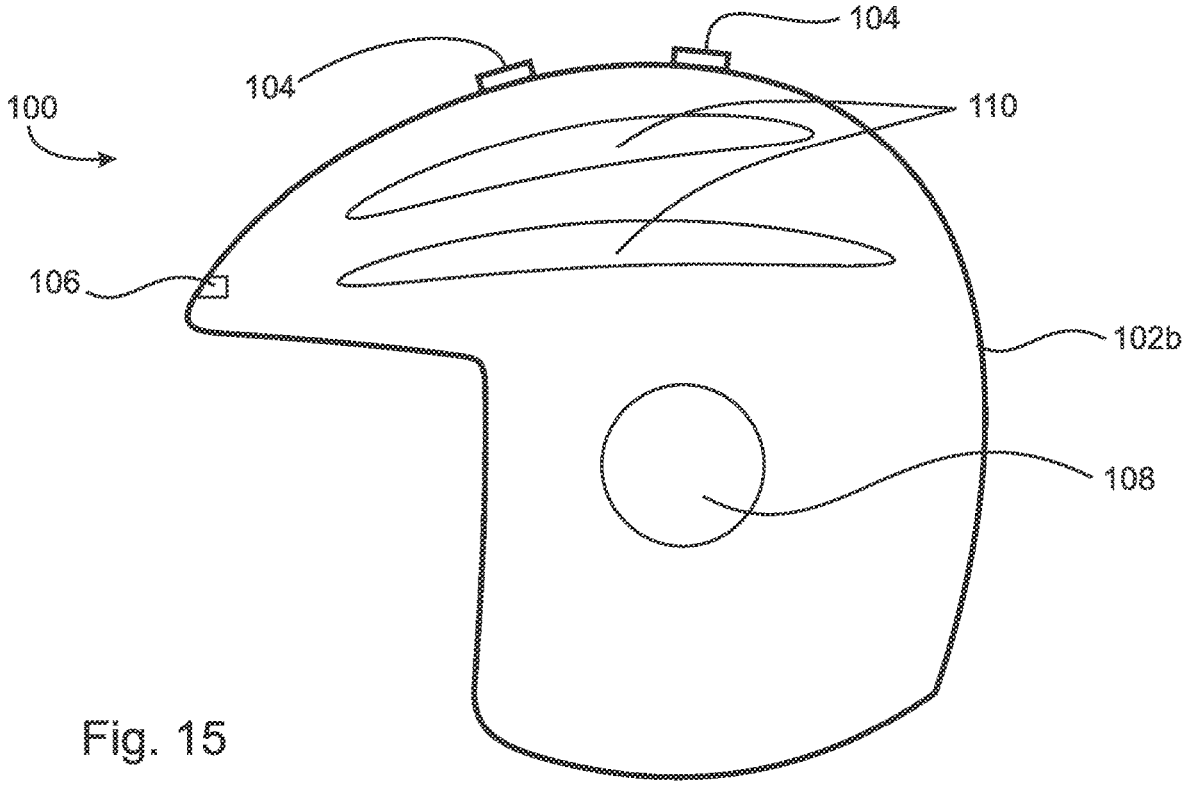
FIG. 15 is a side view of the two section embodiment of the articulating helmet with the addition of air vents.
Figure 16:
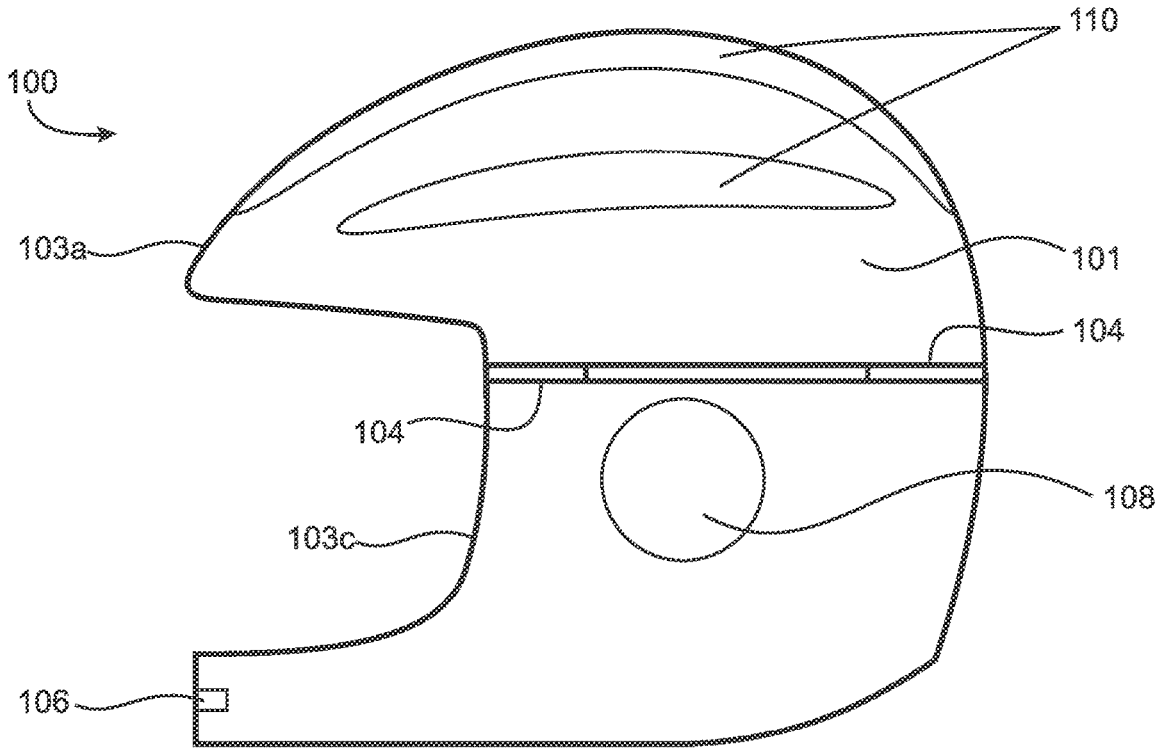
FIG. 16 is a side view of the three section embodiment of the articulating helmet showing two hinges for the articulating means.

FIG. 15 is a side view of the two section embodiment of helmet 100 with the addition of air vents 110. Also seen are two hinges 104. Similarly, FIG. 16 is a side view of the three section embodiment of helmet 100 showing two hinges 104 for section 102*c*.

Figure 17:
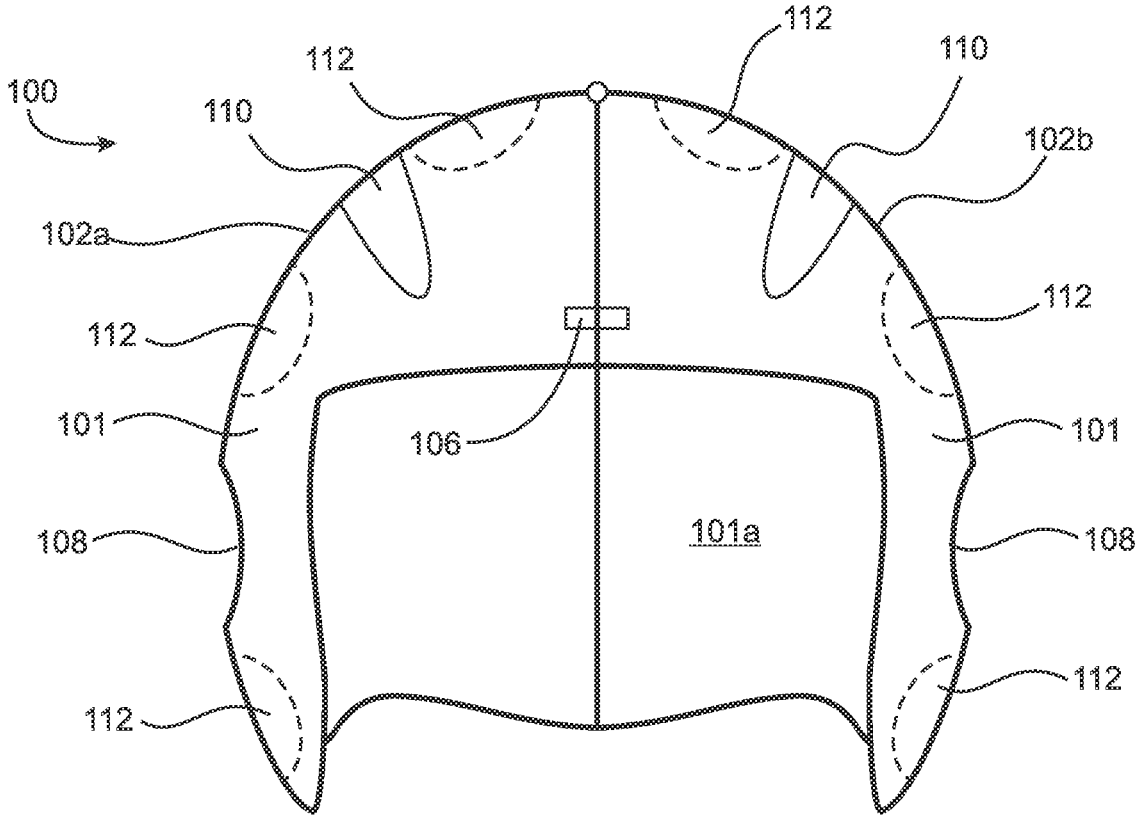
FIG. 17 is a front view of an additional alternate embodiment of articulating helmet 100 in which pads or cushions are attached to the inner surface of the helmet.

FIG. 17 is a front view of another alternate embodiment of articulating helmet 100 in which pads or cushions 112 are attached to inner surface 101*a* of helmet 100. Pads 112 may either be permanently attached to the inner surface 103 (not seen in FIG. 17) with suitable attachment devices such as rivets or screws or by adhesives. Pads may be made of foam materials well known in the art.

Alternatively, pads 112 may by releasably attached to inner surface 103 using hook and loop material such as VELCRO®. This provides the advantage of enabling the user to obtain and arrange cushions 112 that will provide a snug fit when helmet 110 is worn. In both embodiments, pads 112 are attached to inner surface 101*a* between vents 110 to ensure as much air as possible reaches the user.

Figure 17A:
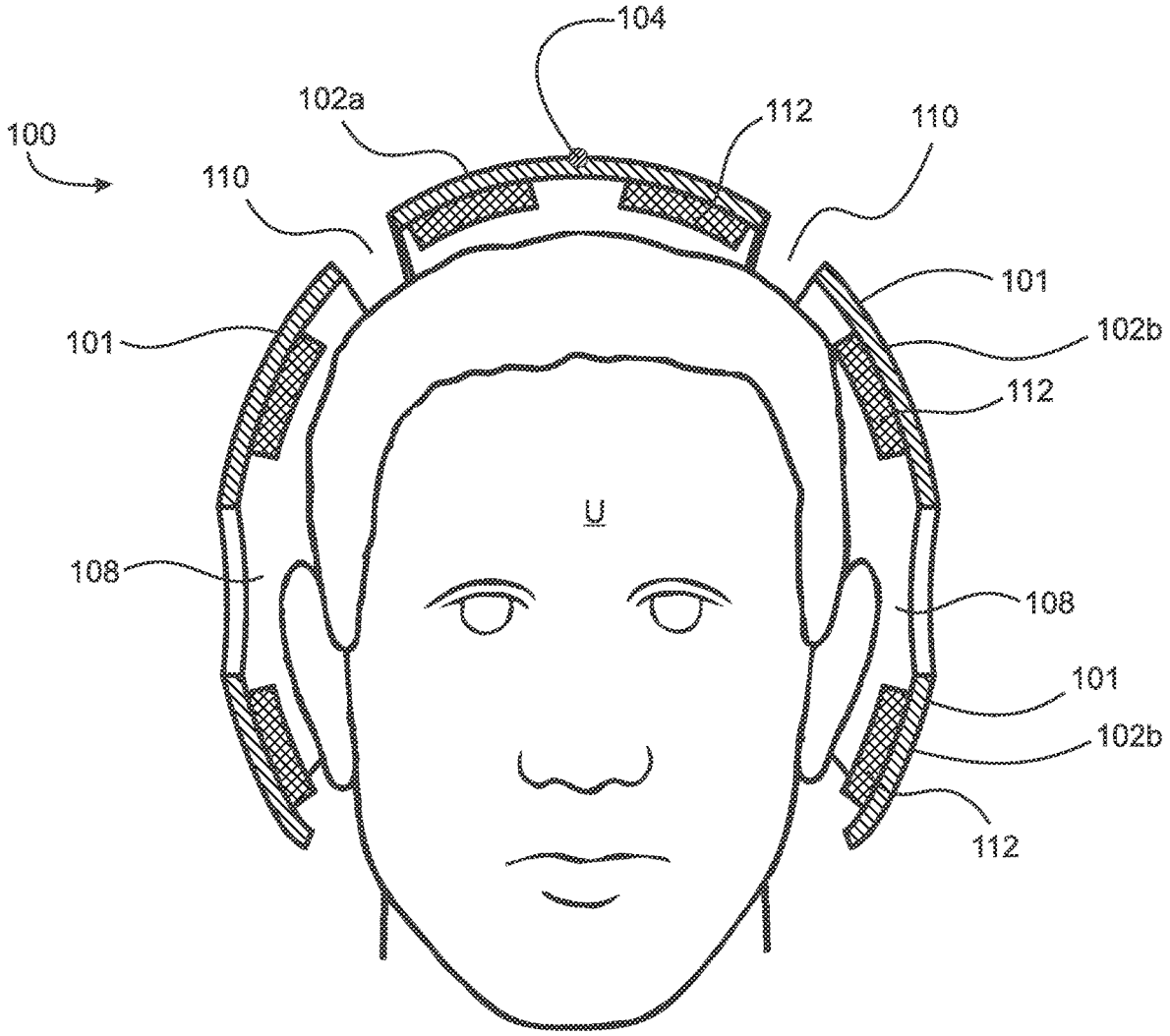
FIG. 17A is a front view of a user wearing the articulating helmet in a cross section view demonstrating the fit of the helmet on the user.

FIG. 17A is a front view of a user showing articulating helmet 100 which is seen in cross section. Pads 112 are seen contacting the top of the head of user U providing a snug fit. Note that pads 112 are attached to inner surface 101*a* in such a way as to leave air vents 110 open to provide air flow to the head. In this embodiment, ear apertures 108 are covered with a membrane or diaphragm 108*a*. In one embodiment, diaphragm 108*a* is fabricated from KEVLAR® fabric.

Figure 18:
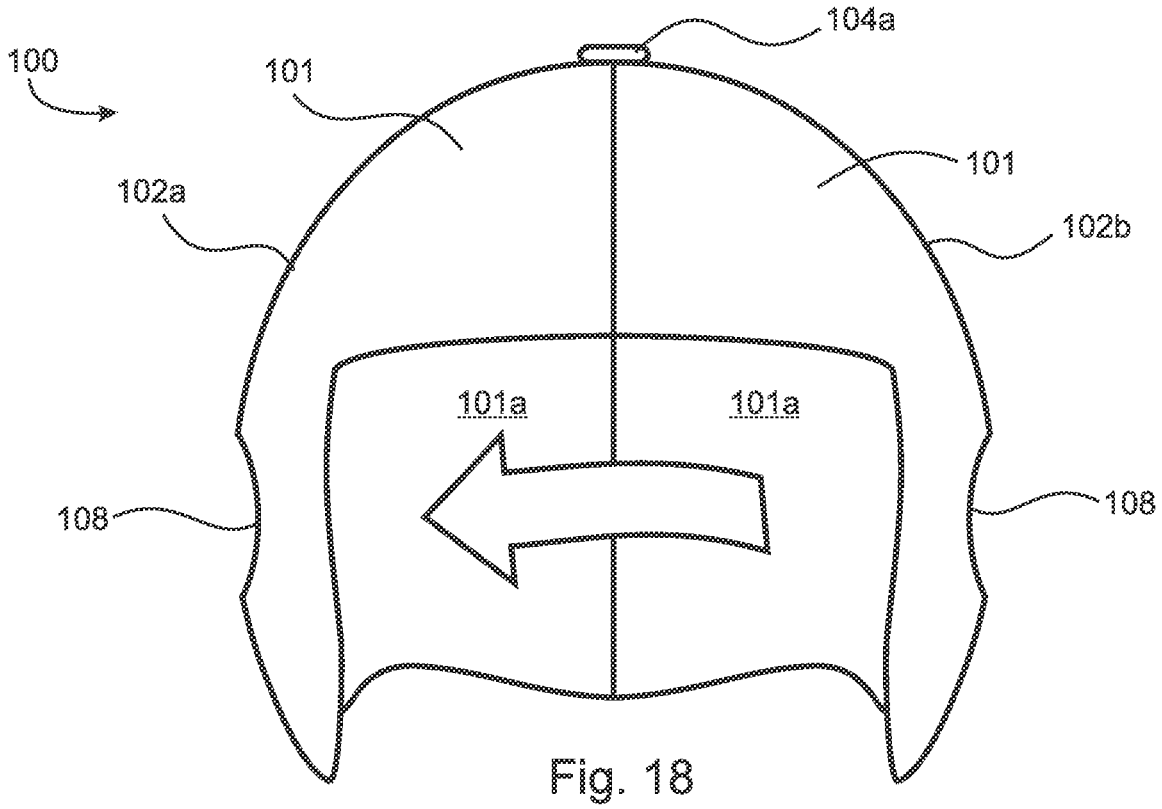
FIGS. 18 and 18A are front views of the articulating helmet demonstrating an embodiment in which one section of the helmet may nest inside the other section.
Figure 18A:
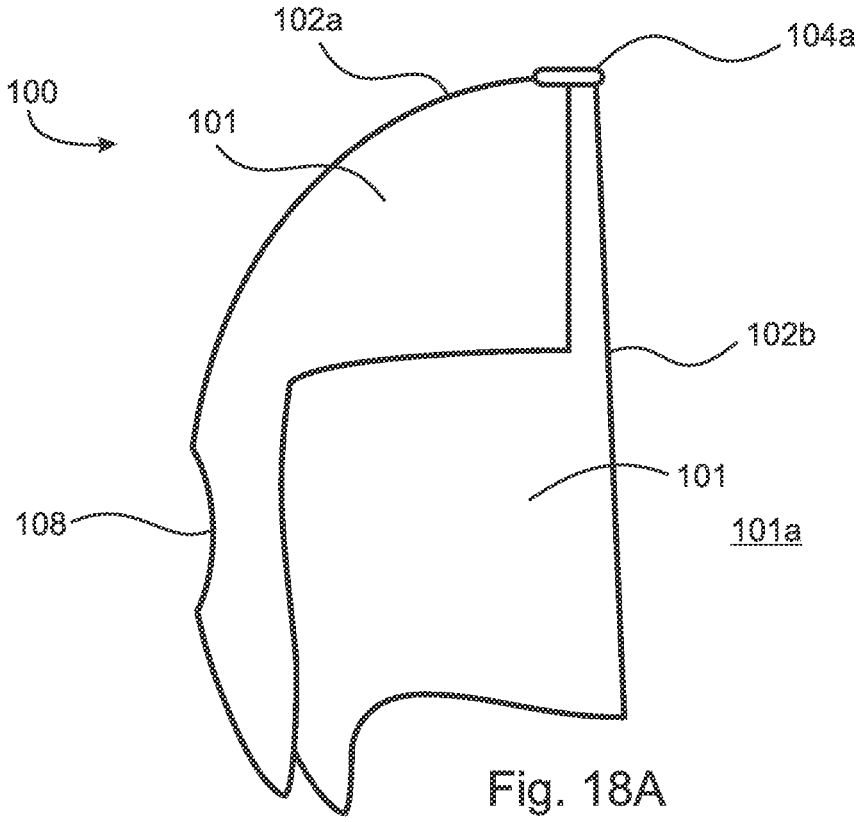

FIGS. 18 and 18A are front views of articulating helmet 100 demonstrating an embodiment in which one section of helmet 100 may nest inside the other. In FIG. 18A, section 102*b* is nested inside section 102*a*. Articulating means 104*a* is a swivel that not only holds the two sections together, but is also configured to allow sections 102*a* and 102*b* to open and to turn so that the outer surface of outer shell 101 of one section faces inner surface 101*a* of the other section. This embodiment provides the advantage of decreasing the overall volume of helmet 100 in the open position making it easier to store.

Figure 19A:
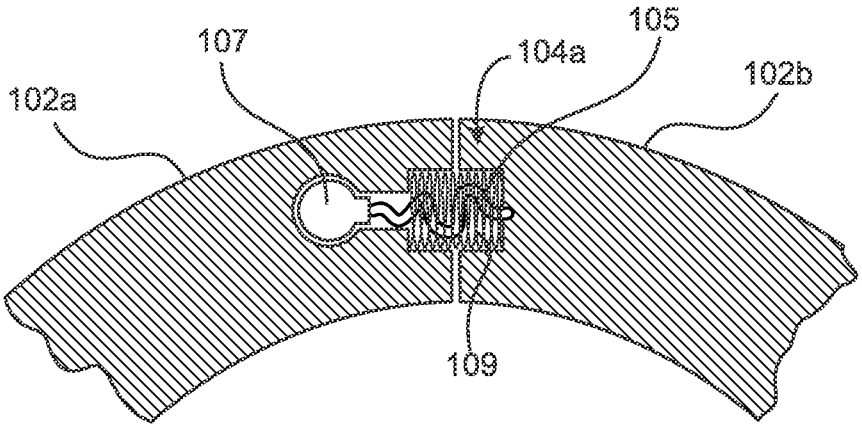
FIG. 19A depicts an enlarged cross section view of one embodiment of a swivel that enables two articulating sections of an articulating helmet to turn nest within one another.
Figure 19B:
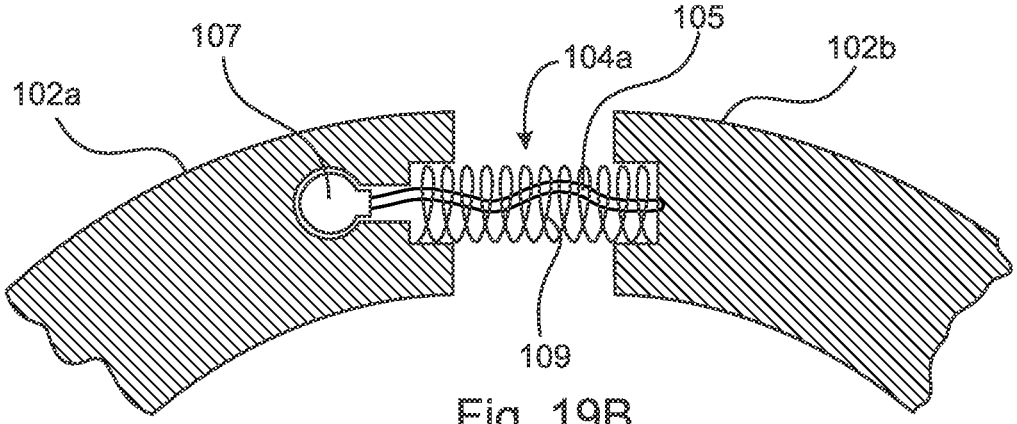
FIG. 19B depicts an enlarged cross section view showing the two articulating sections of the articulating helmet pulled apart prior to being turned into the nesting position.

FIG. 19A depicts an enlarged cross section view of one embodiment of swivel means 104*a* that enables sections 102*a* and 102*b* to turn nest within one another. Cable 105 is attached to section 102*b* and universal joint 107. Universal joint 107 is attached by spring 109 to section 102*b* and is embedded in section 102*a*. Spring 109 acts to pull cable 105 plus attached section 102*b* toward section 102*a*. Universal joint 107 allows cable 105 to rotate. FIG. 19B shows the two sections 102*a* and 102*b* pulled apart with stretched spring 105 holding the two sections together. Also seen are male prongs or tubes 120 which slide into ports 122 to stabilize the helmet when sections 102*a* and 102*b* are joined together.

Figure 19C:
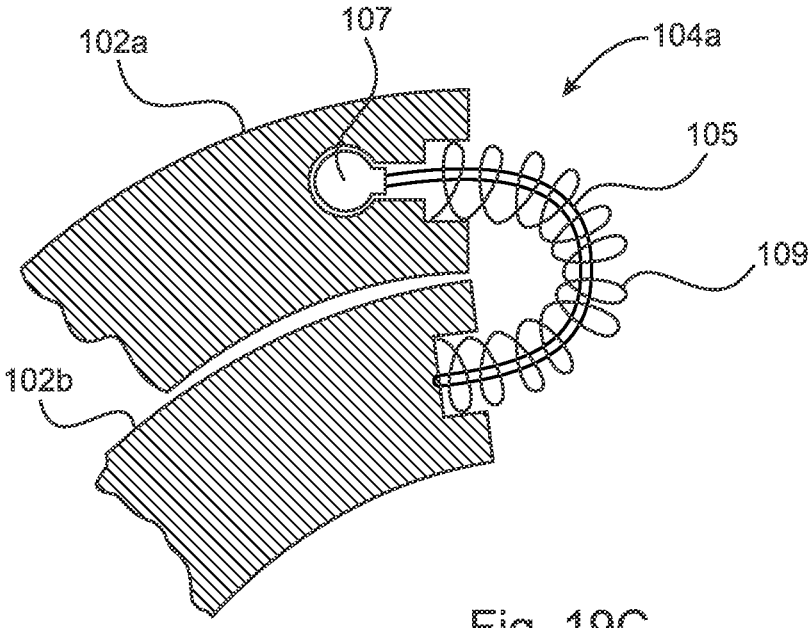
FIG. 19C depicts an enlarged cross section view of the two articulating sections in the nested position.

As seen in FIG. 19C, universal joint 107 enables section 102*b* to rotate relative to section 102*a* after which section 102*b* is pulled back toward section 102*a*. Because section 102*b* has been rotated, it will nest against inner surface 101*a* of section 102*a*.

Figure 20:
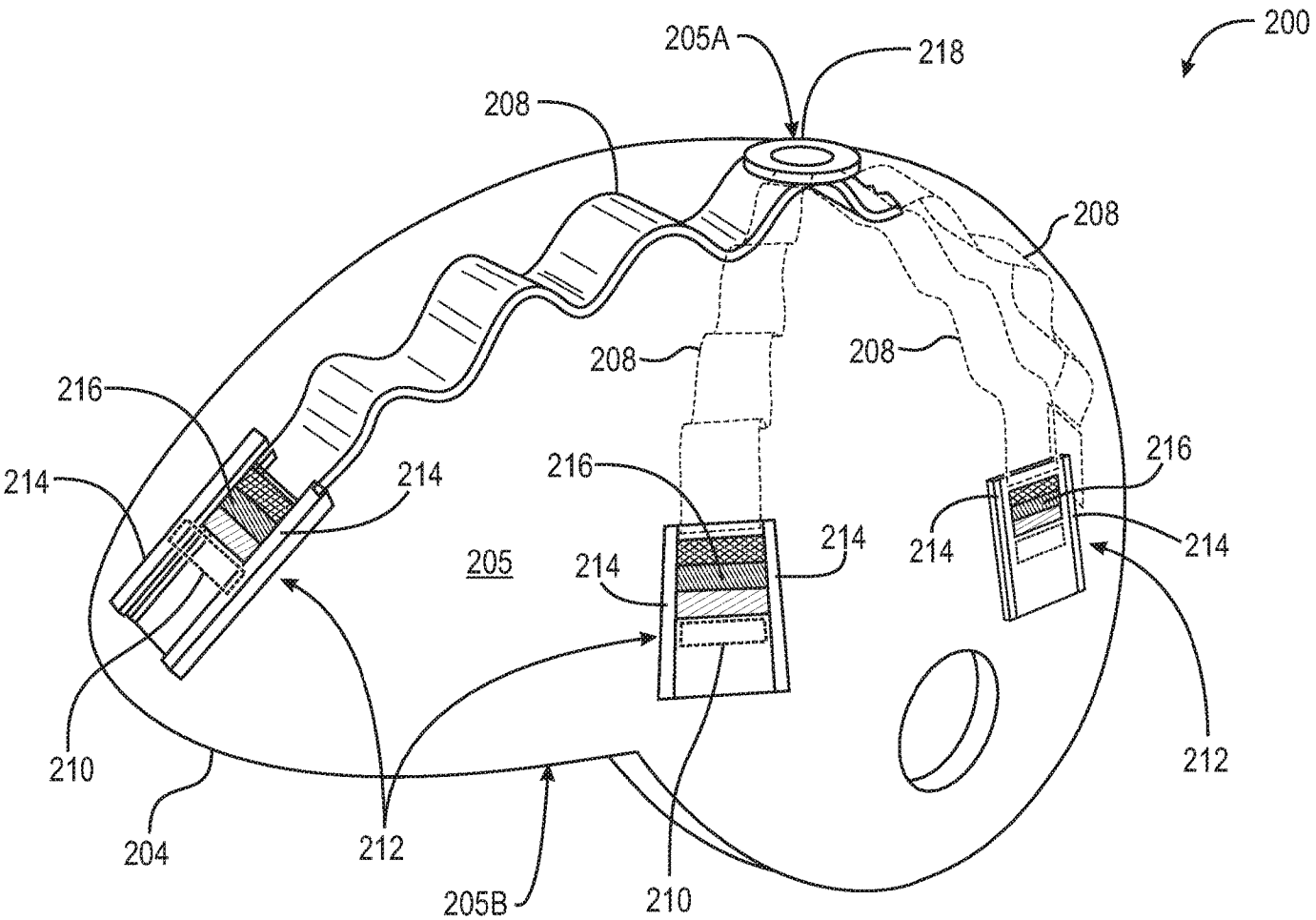
FIG. 20 is a side perspective view of an additional embodiment of the helmet of the current invention.

FIG. 20 is a side perspective view of a further additional embodiment of the helmet of the current invention with outer shell 202 removed. Helmet 200 includes an integral or continuous outer shell 202 (not shown in FIG. 20) and inner shell 204 functionally connected. By integral or continuous is meant that shell 202 is formed as a single unit. By functionally connected is meant that outer shell 202 and inner shell 204 are connected such that outer shell 202 may move, such as rotate, relative to inner shell 204 such as, for example, the sliding connection 22 discussed above. Inner shell 204 comprises crown 205A and lateral edge 205B. Elastomeric zone 203 ("zone 203") lies between outer shell 202 and inner shell 204. At least one sinusoidal spring 208 (spring(s) 208") is positioned in zone 203. FIG. 20 depicts a preferred embodiment in which a plurality of springs 208 are positioned in zone 206. In a more preferred embodiment shown here, springs 208 are sinusoidal springs 208 having a shape similar to or identical with a series of sine waves and can be manufactured as described in U.S. Patent Application Publication No. 2012/00773884 and U.S. Pat. No. 4,708,757 both to Guthrie which patent publications are hereby incorporated by reference in their entireties.

Although not necessary for the protective function of helmet 200, in a further embodiment, the distal end of at least one of springs 208 is in operative contact with force indicator tab 216 ("tab 216"). By operative contact is meant that a component or device contacts but is not connected to a second component and causes that second component to function. For example, as described below, the operative contact end of spring 208 contacts the proximal edge of tab 216 so that when spring 208 is extended, it pushes tab 216 to an outer position toward the outer perimeter of helmet 200. When spring 208 retracts, tab 216 remains in its outer position. Tab 216 preferably is a multi-color panel as represented by the different cross hatching patterns on the surface of tab 216 seen in FIG. 20.

Tab 216 is positioned within channel 212 which is position on outer surface 205 of inner shell 204. Channel 212 includes parallel rails 214 with tab 216 positioned between rails 214. In this way, tab 216 is always pushed in the same direction when spring 206 is extended. Outer shell 202 defines at least one window 210, seen in shadow, positioned so that tab 216 can be viewed through window 210 if spring 208 is extended sufficiently to push tab 216 into channel 212. In the embodiment shown, rivet 218 forms the attachment of the plurality of springs 206 to outer shell 202 to form a radial or "spider-like" array of springs 208.

Figure 20A:
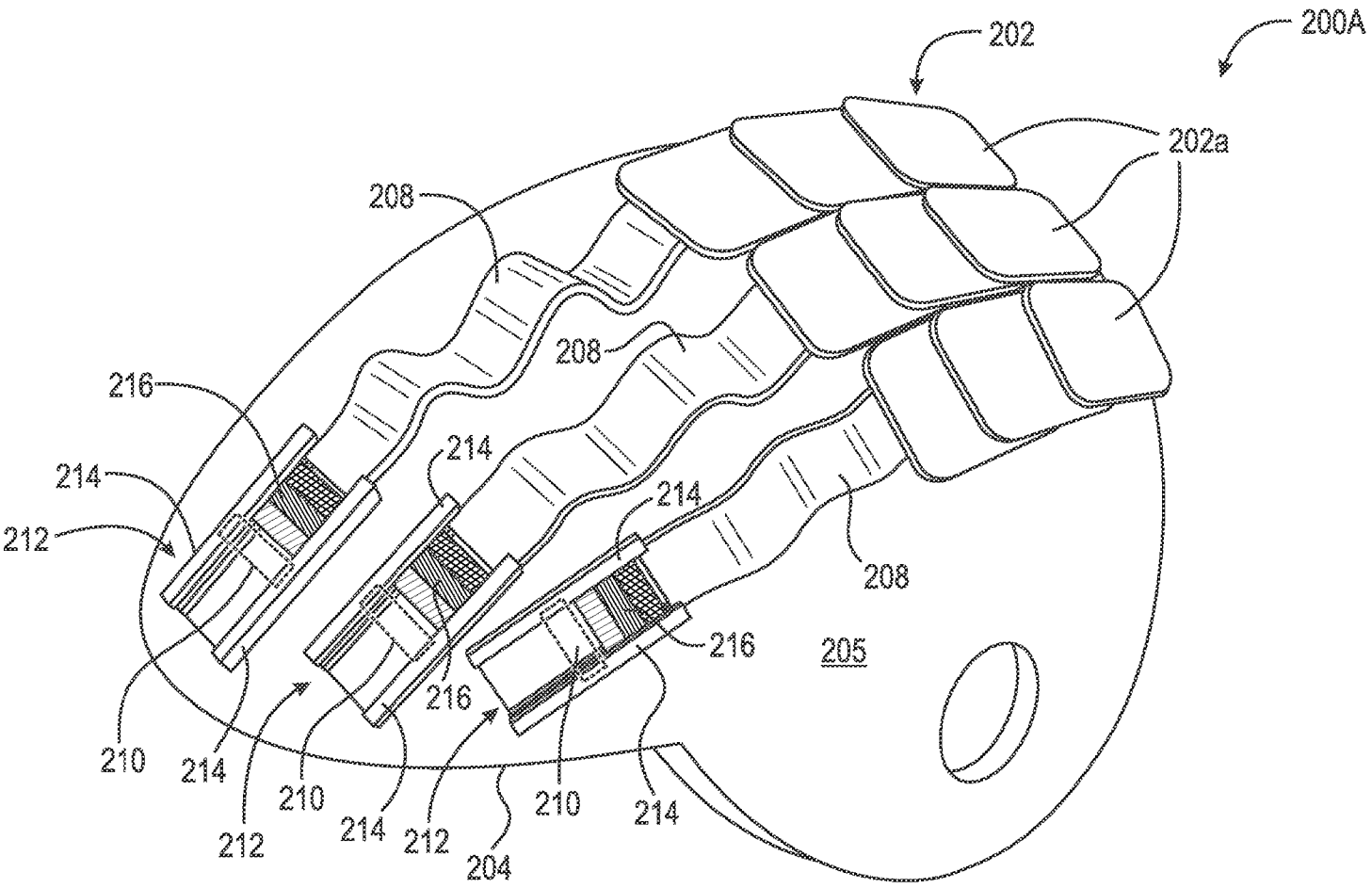
FIG. 20A depicts an alternate embodiment of the helmet shown in FIG. 20 in which the outer surface comprises overlapping plates that extend over the helmet and together form the outer wall of the elastomeric zone.

FIG. 20A depicts an alternate embodiment of the helmet labeled helmet 200A in which outer shell 202 comprises overlapping plates 202*a* ("plates 202*a*") which extend over helmet 200 and forms the outer wall or cover of elastomeric zone 203. Plates 202*a* may be arranged in rows. FIG. 20A also depicts a preferred arrangement of sinusoidal springs 208 in which three springs 208 extend along inner shell 204 with the at least one end of at least one springs 208 in operative contact with tabs 216. As shown, springs 208 may be arranged separately under rows of plates 202*a*. Although not shown in FIG. 20A, the opposing ends of each of springs 208 may also be in operative contact with a tab 216. As is also seen in FIG. 20, tab 216 is positioned within rails 214 of channel 212. Outer shell 202 defines at least one window 210 in one of plates 202*a* positioned so that tab 216 can be viewed through window 210 if spring 208 is extended sufficiently through channel 212.

Figure 21:
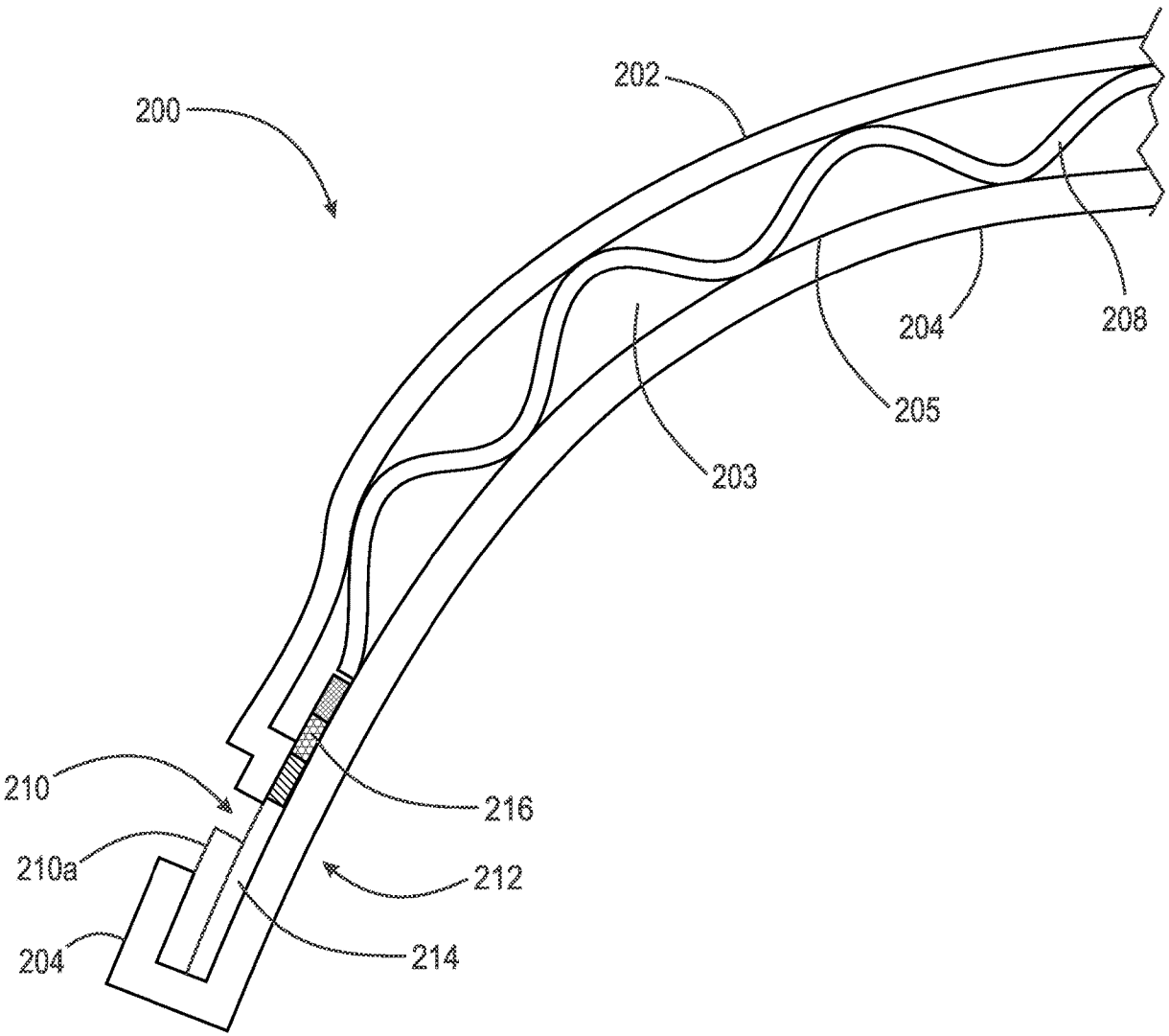
FIG. 21 is a cross section of the helmet through one of the sinusoidal springs.

FIG. 21 is a cross section of helmet 200 through a sinusoidal spring 208. Spring 208 is positioned in elastomeric zone 203 resting on surface 205. One end of spring 208 is either close to or in contact with tab 216 which is positioned between rails 214. In the resting or neutral position shown, tab 216 is under outer shell 202 and not exposed under window 210. Spring(s) 208 may be attached to either outer shell 202 or inner shell 204.

Figure 22:
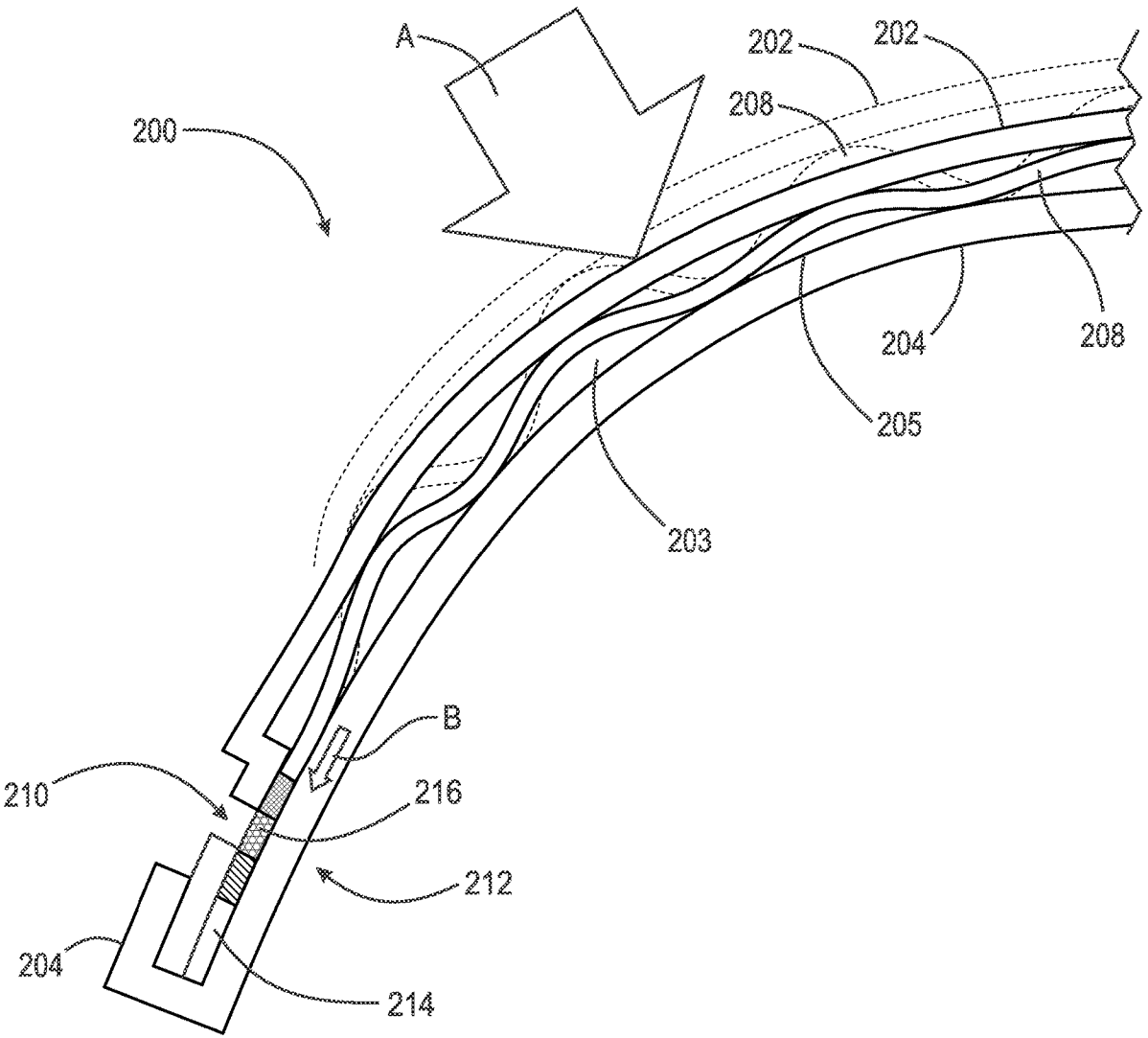
FIG. 22 shows the same view of the helmet as seen in FIG. 21 showing force, such as from a blow or hit, is applied to the helmet.

FIG. 22 shows the same view of helmet 200 as seen in FIG. 21 in which force A, represented by arrow A, is applied to helmet 200. The force may be a blow impacting helmet 200. The shaded view of outer shell 202 and spring 208 show those components in the neutral state. The solid view shows outer shell 202 pressed into elastomeric zone 203 by force A. When force A strikes shell 202, one or more of springs 208 are pushed into a compressed mode as seen by the reduced amplitude of the sine wave formed in sinusoidal spring 208 as well as the expanded length of spring 208. As it spring 208 lengthens, as represented by arrow B, it pushes tab 216 toward and/or into window 210. Persons of skill in the art will recognize that the increase in length of spring 208 is a function of the amount of force striking helmet 200.

Thus, the amount of exposure of tab 216 in window 210 depends on the amount of force striking helmet 200. Preferably, tab 216 includes different colors, such as green, yellow, and red, or other indicators, each of which may appear in window 210 depending on the force of the blow. It will be recognized that more than one spring 208 may be extended when helmet 200 is struck.

Figure 23:
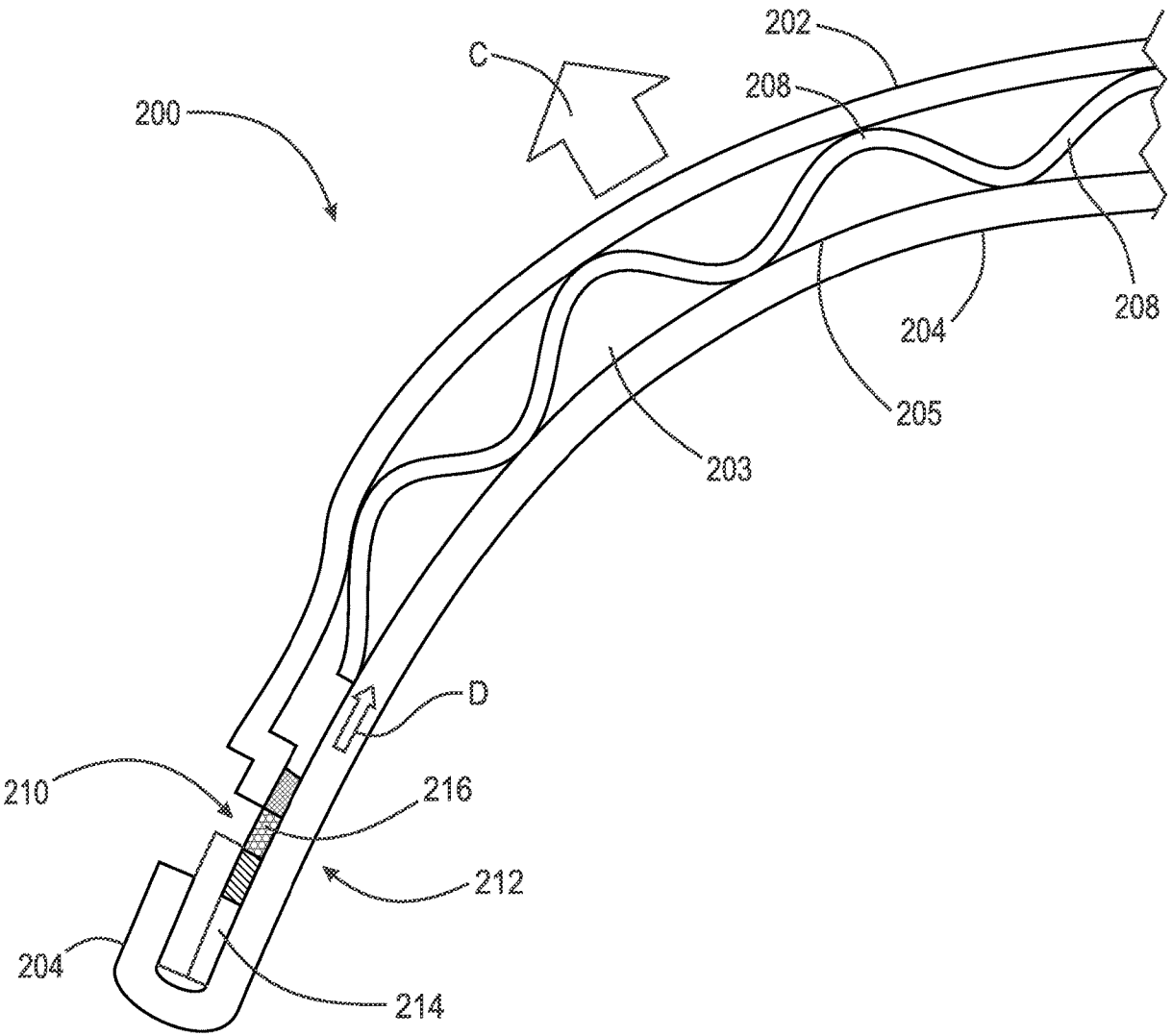
FIG. 23 depicts the same view seen in FIGS. 21 and 22 after the outer shell and sinusoidal spring have returned to the neutral position.

FIG. 23 depicts the same view seen in FIGS. 21 and 22 after outer shell 202 and sinusoidal spring 208 have returned to the neutral position. The return movement of outer shell 202 is shown by arrow C while the return of spring 208 is shown by arrow D. Tab 216 is seen remaining under window 210 after spring 208 retracts.

Figure 24:
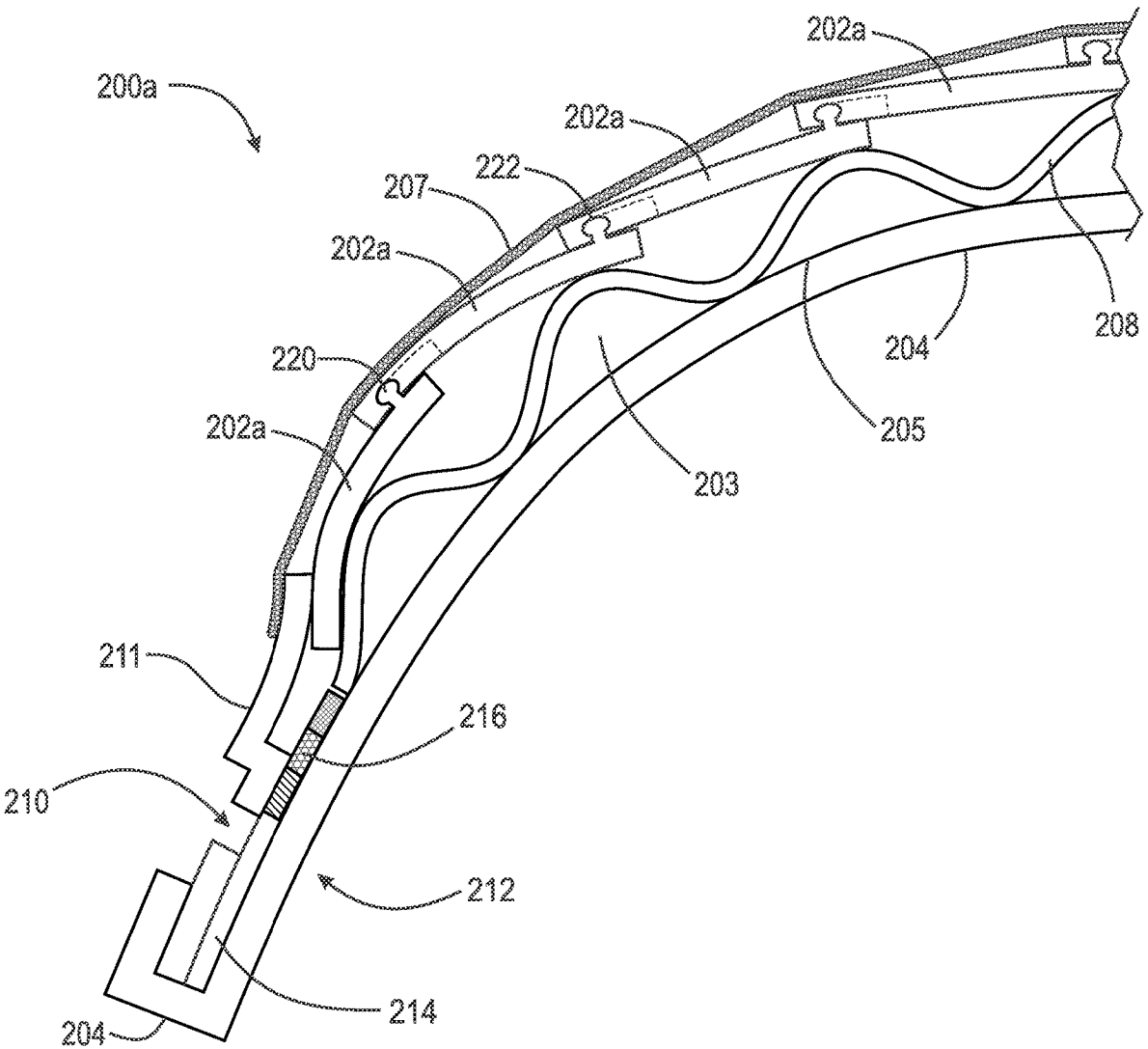
FIG. 24 is a cross section of the alternate embodiment of the helmet seen in FIG. 20A depicting how the overlapping plates are connected to each other and retain the ability to move in response to forces applied to the helmet.

FIG. 24 is a cross section of helmet 200*a* seen in FIG. 20A depicting how overlapping plates 202*a* are connected to each other and still retain the ability to move in response to forces applied to helmet 200*a*. Sinusoidal spring 208 is seen confined between plates 202*a* and outer surface 205 of inner shell 204. Also seen is the distal end of spring 216 in operative contact with force indicator tab 216. Window 210 is seen defined by an edge portion 211 of helmet 200*a*. It may also be defined by one of plates 202*a*. In one embodiment, articulating plates 202*a* are attached using a male-female connection in which a round pin 220 is inserted into round socket 222. This connection enables the individual plates to pivot on pin 220 transversely or side-to-side and up and down to deflect some of the force away from the user's head while still preserving the integrity of the entire outer shell. Also seen is cover 207 which may overlay articulating plates 202*a*. Preferably, cover 207 is made from a fabric such as KEVLAR® that provides an integral cover over the individual plates 202*a* but allows movement of individual plates. Persons of skill in the art will recognize the articulating plates 202*a* can be replaced by an integral hard outer shell 202 as seen in FIG. 20 above.

Figure 25:
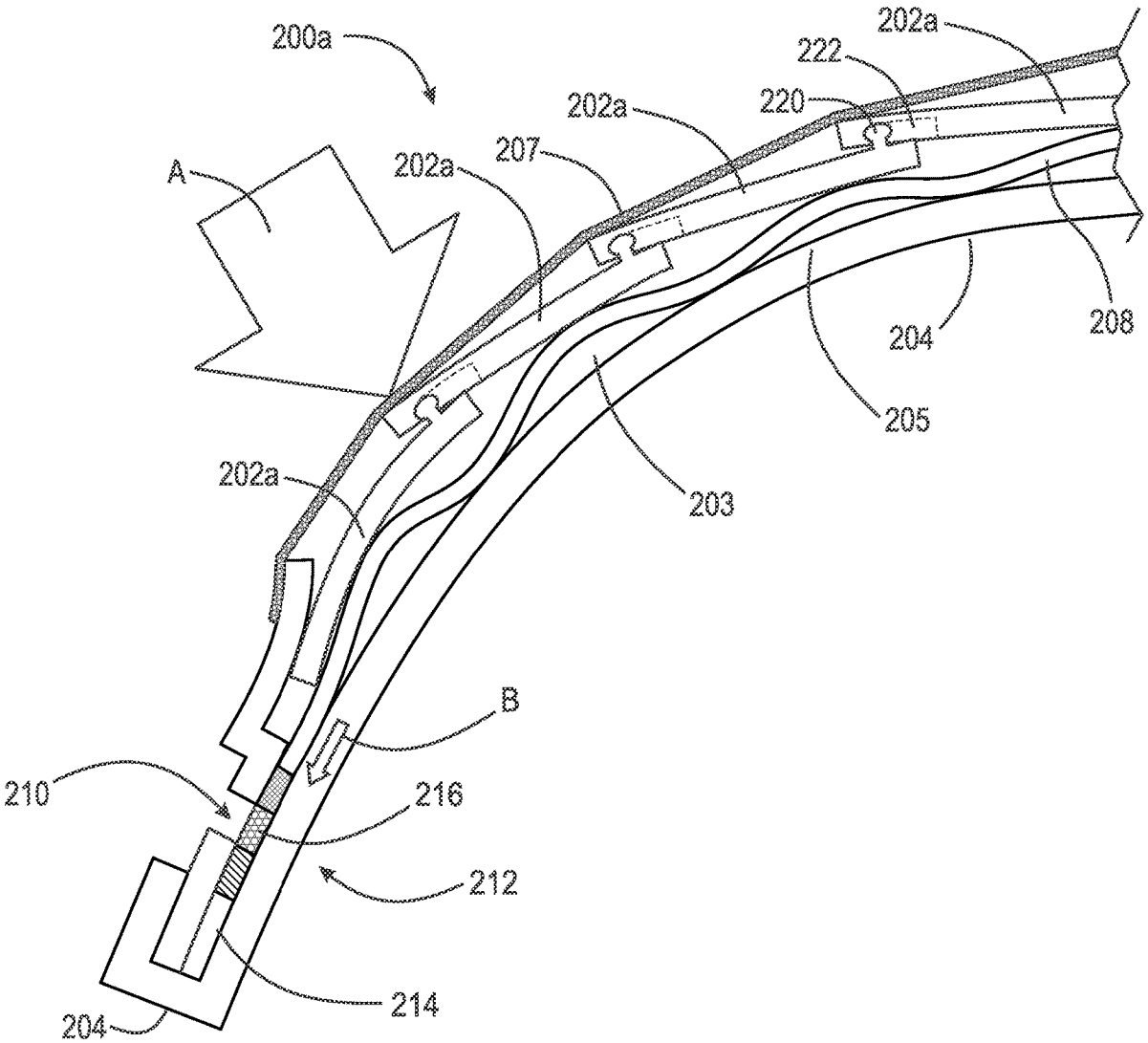
FIG. 25 shows the same view of the helmet as seen in FIG. 24 showing force, such as from a blow or hit, when it is applied to the helmet.
Figure 26:
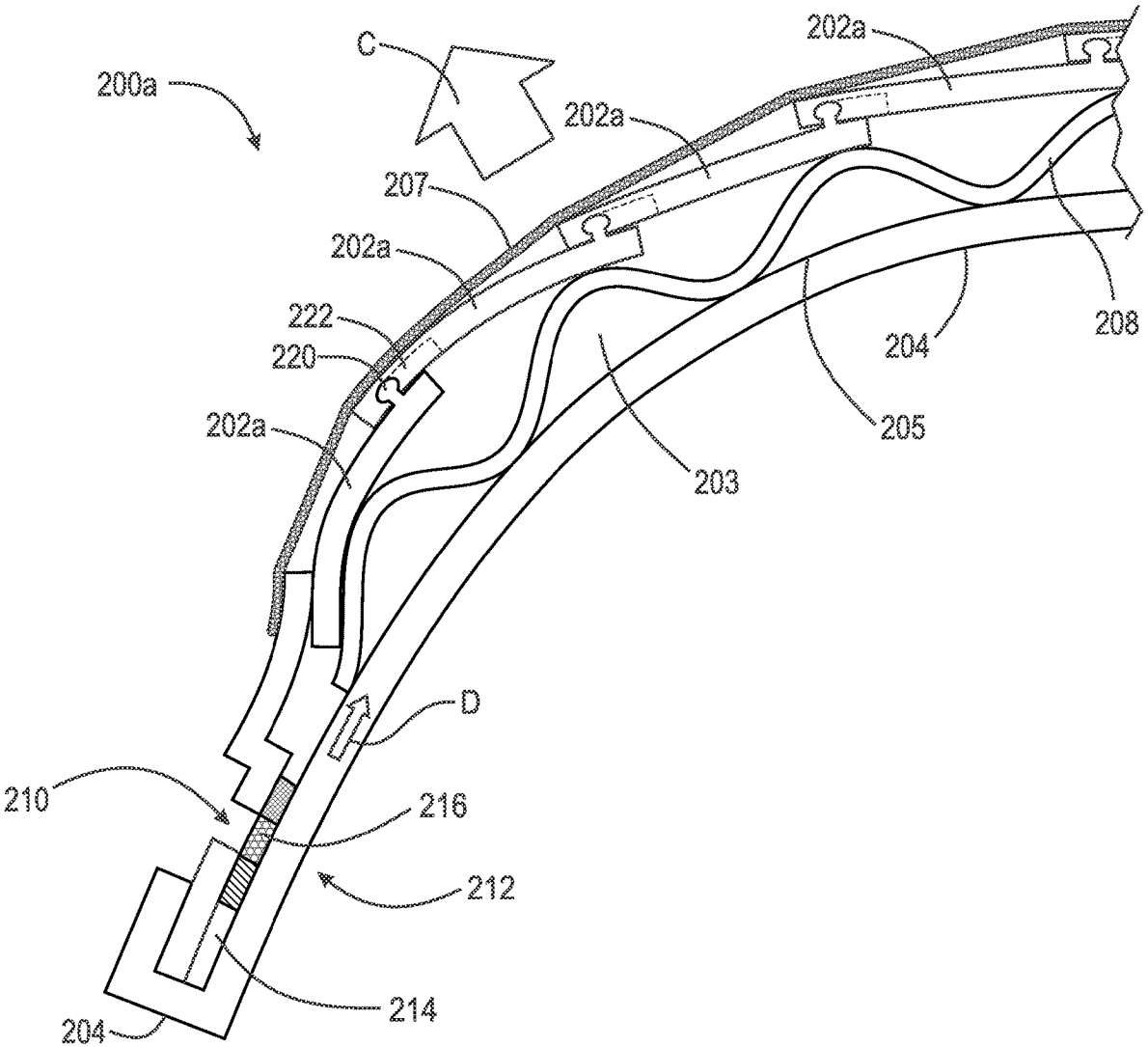
FIG. 26 depicts the same view seen in FIGS. 24 and 25 after the outer shell and sinusoidal spring have returned to the neutral position.

FIGS. 25 and 26 are similar to FIGS. 22 and 23, respectively, in showing outer shell 202*a* compressed by force A and returning to the neutral state as represented by arrow C. As with helmet 200 discussed above, tab 216 remains displayed in window 210 indicating at least semi-quantitatively, the amount of force that struck helmet 202*a*, after spring 208 retracts (arrow D). By semi-quantitatively is meant that the degree of exposure of tab 216 under window 210 indicates if a one impact hits helmet 200 with greater force than a second impact, even if an exact measurement of each impact is not obtained.

The indicator(s) on tab 216 displayed in window 210 can be used to show how far spring 208 extended and thus the amount of force that struck helmets 200 and 200*a*. Springs 208 may be fabricated with suitable calibrated or measured tension using known methods to extend to appropriate lengths depending on the force of the impact to indicate in at least a semi-quantitative manner the amount of force striking helmet 200 (or helmet 200*a*) and thus possibly affecting the user. Tab 216 may be returned to its neutral position using a screwdriver or other implement to move it back into operative contact with spring 208. In some embodiments, a minimum or sufficient amount of force may be necessary to move tab 216 into window 210. If the striking force is below this minimum, spring 208 will not lengthen sufficiently to move tab 216 into window 210 indicating the striking force was insufficient to cause injury to the user.

Figure 27:
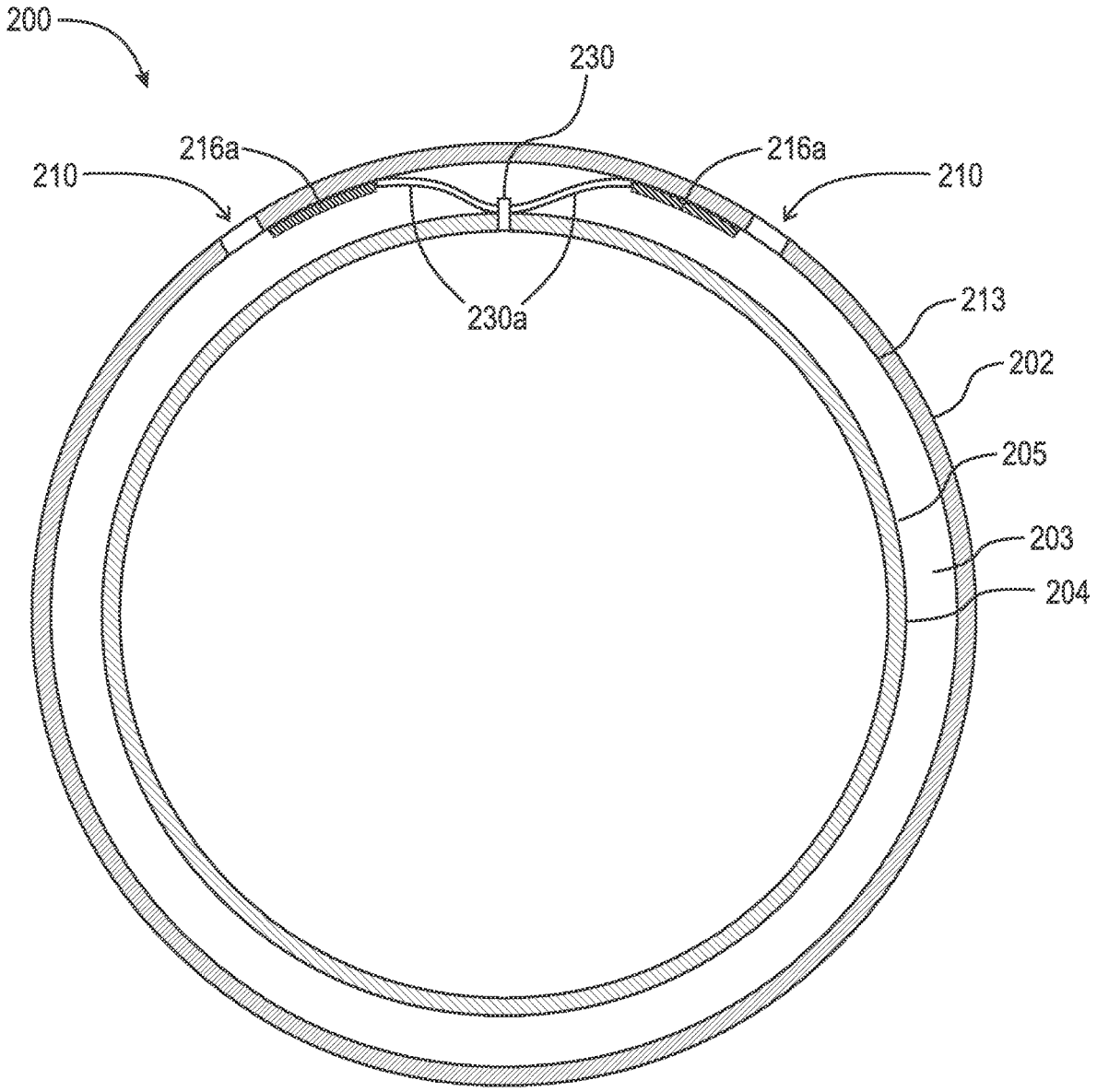
FIG. 27 is a transverse cross section illustrating another alternate embodiment of helmet to include a tab indicator to measure at least semi-quantitatively rotational force striking helmet the helmet.

FIG. 27 is a transverse cross section illustrating another alternate embodiment of helmet 200 to include a tab indicator to measure at least semi-quantitatively rotational force striking helmet 200. In this view, sinusoidal springs 208 are removed for clarity but persons of skill in the art will recognize that at least one spring 208 may be used in helmets 200 and 200*a* with this embodiment. Support 230 is fixedly attached to inner shell 204 on surface 205. Support 230 extends across zone 203 and contacts inner surface 213 of outer shell 202. Arms 230*a* extend from support 230 generally transversely along inner surface 213 of outer shell 202. Arms 230*a* are in operative contact with tab indicators 216*a* which are positioned in rails 214 (not shown).

Figure 28:
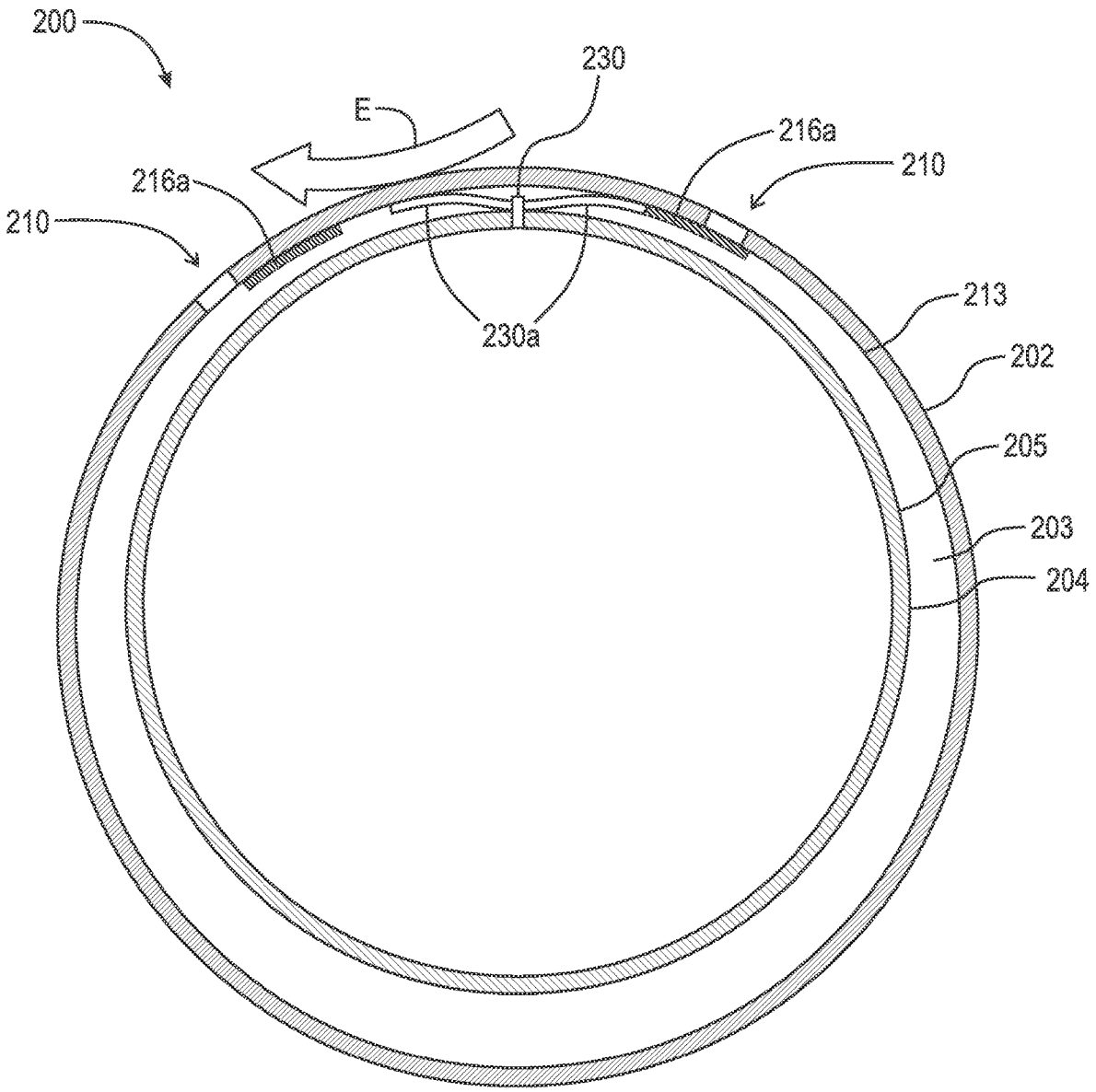
FIG. 28 is the transverse cross section seen in FIG. 27 depicting the movement of the outer shell into the elastomeric zone when struck by rotational force represented by the arrow, i.e. force striking from an angle relative to the helmet; and, FIG. 29 is the transverse cross section seen in FIG. 27 representing the outer shell after it is returned to the neutral position after being struck by a rotational force with a tab indicator displayed in a window.
Figure 29:
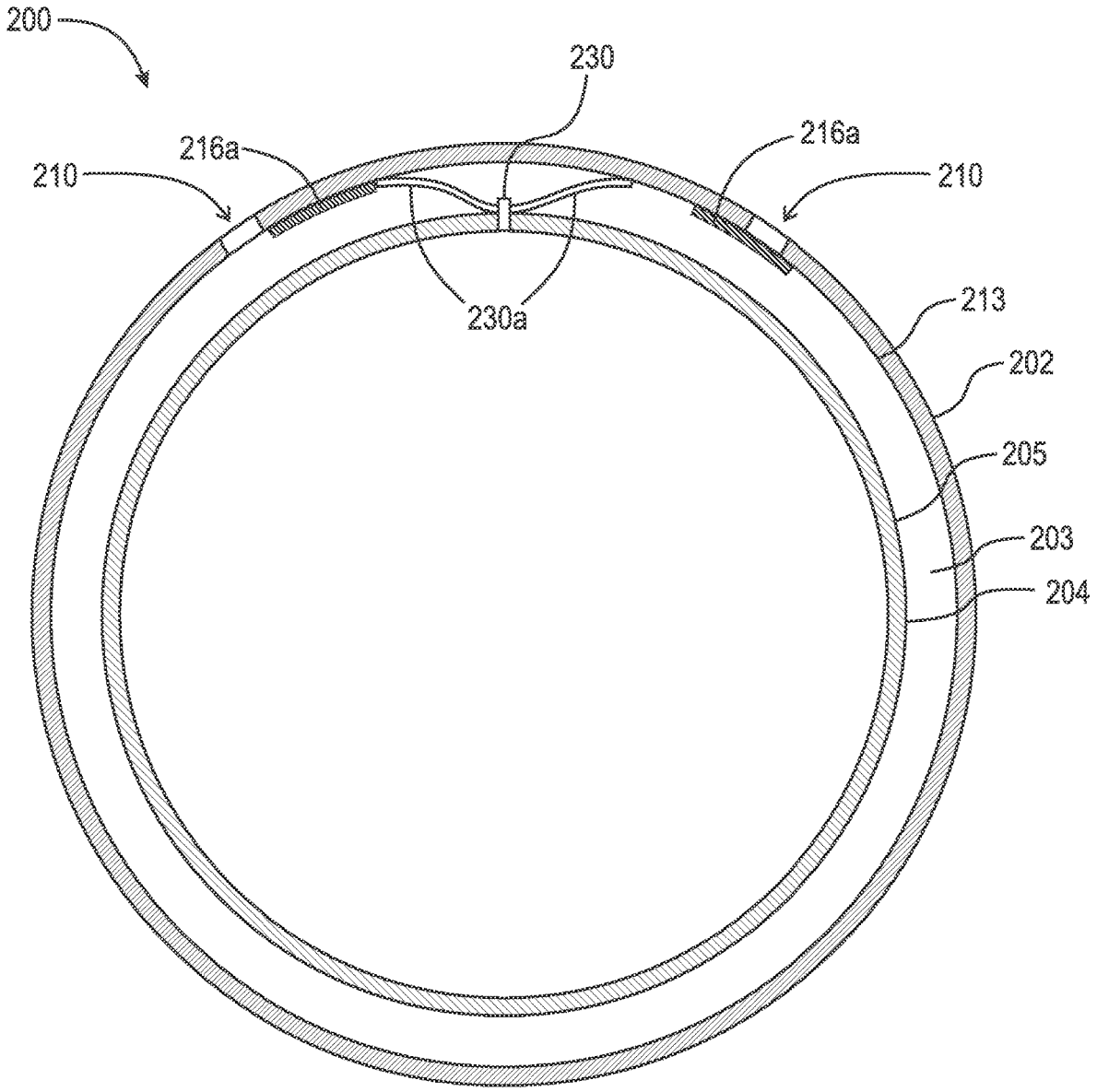

In FIG. 28, double arrow E represents rotational force, e.g. force striking from an angle relative to helmet 200 (or helmet 200*a*). Because inner shell 204 is stationary relative to the rotational motion of outer shell 202, which is suspended on inner shell 204 by springs 208, support 230 and attached arms 230*a* remain stationary relative to outer shell 202. Tab indicators 216*a* rotate with outer shell 202 against stationary arms 230*a* which forces them to move along rails 214. As seen in FIG. 29, when outer shell 202 returns to the neutral position after the hit, tab indicator 216*a* remains in rails 214 where they have been pushed. If the rotational force is sufficient, tab indicators 216*a* will be displayed in window 210 indicating helmet 200 was hit with sufficient rotational force to display indicator 216*a*, thus indicating a possible injury to the user.

Thus it is seen that the objects of the invention are efficiently obtained, although changes and modifications to the invention should be readily apparent to those having ordinary skill in the art, which changes would not depart from the spirit and scope of the invention as claimed.

What is claimed is:

1. A protective helmet having multiple protective zones, comprising:

an inner shell having a first inner surface and a first outer surface;

a hard outer shell having a second inner surface and a second outer surface, said hard outer shell functionally attached to said inner shell;

an elastomeric zone between said first outer surface and said second inner surface; and, a plurality of sinusoidal springs positioned in said elastomeric zone, each of said plurality of sinusoidal springs including:

a length and a width, the length being greater than the width and extending between a first end and a second end, wherein:

the first end arranged at a first location of the protective helmet, the first location being at a first circumferential distance along the first outer surface from a crown of the helmet;

the second end arranged at a second location of the protective helmet, the second location being at a second circumferential distance along the first outer surface from the crown of the helmet, the second circumferential distance being greater than the first circumferential distance;

in a neutral position, the first end is spaced from said second end by a first distance; and, when a force strikes the helmet, the first end is spaced from the second end by a second distance, the second distance being different from the first distance.

2. The protective helmet as recited in claim 1 wherein said second outer surface is a continuous outer surface.

3. The protective helmet as recited in claim 1, wherein said hard outer shell comprises a plurality of overlapping plates.

4. The protective helmet as recited in claim 3, further comprising a cover positioned over said plurality of overlapping plates.

5. The protective helmet as recited in claim 3, wherein said plurality of overlapping plates is arranged in at least two rows.

6. The protective helmet as recited in claim 5, wherein at least one of said plurality of sinusoidal springs is positioned under at least one row of said at least two rows.

7. The protective helmet as recited in claim 6, wherein at least two of said plurality of sinusoidal springs are positioned under at least one row of said at least two rows.

8. The protective helmet as recited in claim 3, wherein each of said plurality of overlapping plates is attached to at least one other overlapping plate.

9. The protective helmet as recited in claim 1, wherein at least one of said plurality of sinusoidal springs is attached to said first outer surface.

10. The protective helmet as recited in claim 1, wherein at least one of said plurality of sinusoidal springs is attached to said second inner surface.

11. The protective helmet as recited in claim 1, wherein said outer shell has at least one window defined by said hard outer shell.

12. The protective helmet as recited in claim 11, further comprising a force indicator tab in operative contact with at least one end of at least one of said plurality of sinusoidal springs; wherein said force indicator tab is moved to said at least one window by said at least one end of said at least one of said plurality of sinusoidal springs when said helmet is impacted with sufficient force.

13. The protective helmet as recited in claim 12, wherein said force indicator tab is positioned in a slot or between two rails.

14. The protective helmet as recited in claim 11, wherein said at least one window extends in a sagittal direction.

15. The protective helmet as recited in claim 1, wherein said functional attachment includes a portion of said inner shell around an edge of said hard outer shell.

16. The protective helmet as recited in claim 15, wherein an attachment point is on said inner shell.

17. The protective helmet as recited in claim 15, wherein an attachment point is on said outer shell.

18. The protective helmet as recited in claim 1, wherein each one of said plurality of sinusoidal springs is attached at a common point.

19. The protective helmet as recited in claim 1, further comprising a flexible arm fixedly attached to said first outer surface and contacting said second inner surface.

20. A protective helmet having multiple protective zones, comprising:

an inner shell having:
- a first inner surface;
- a first outer surface;
- a crown; and,
- a lateral edge, wherein the lateral edge is located at a bottommost elevational value of the inner shell, and the crown is located at a highest elevational value of the inner shell;

a hard outer shell having a second inner surface and a second outer surface, said hard outer shell functionally attached to said inner shell;

an elastomeric zone between said first outer surface and said second inner surface; and, a plurality of sinusoidal springs positioned in said elastomeric zone, each of said plurality of sinusoidal springs including:
- a length and a width, the length being greater than the width and extending between a first end and a second end, wherein:
  - the first end is arranged proximate the crown; and,
  - the second end is arranged proximate the lateral edge.

21. A protective helmet having multiple protective zones, comprising:

an inner shell having:
- a first inner surface;
- a first outer surface;
- a crown; and,
- a lateral edge, wherein the lateral edge is located at a bottommost elevational value of the inner shell, and the crown is located at a highest elevational value of the inner shell;

a padded inner lining attached to said first inner surface;

a hard outer shell having a second inner surface and a second outer surface, said hard outer shell functionally attached to said inner shell;

an elastomeric zone between said first outer surface and said second inner surface; and, a plurality of sinusoidal springs positioned in said elastomeric zone, each of said plurality of sinusoidal springs including:
- a length and a width, the length being greater than the width and extending between a first end and a second end, wherein:
  - the first end arranged at the crown; and,
  - the second end arranged proximate the lateral edge.

* * * * *